US010926164B2

(12) United States Patent
Rynda et al.

(10) Patent No.: US 10,926,164 B2
(45) **Date of Patent: *Feb. 23, 2021**

(54) PLAYING CARD HANDLING DEVICES AND RELATED METHODS

(71) Applicant: SG Gaming, Inc., Las Vegas, NV (US)

(72) Inventors: Robert J. Rynda, Las Vegas, NV (US); Feraidoon Bourbour, Eden Prairie, MN (US); Ronald R. Swanson, Otsego, MN (US); Attila Grauzer, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 138 days.

This patent is subject to a terminal disclaimer.

(21) Appl. No.: 15/892,698

(22) Filed: Feb. 9, 2018

(65) Prior Publication Data

US 2018/0161665 A1 Jun. 14, 2018

Related U.S. Application Data

(63) Continuation of application No. 14/939,462, filed on Nov. 12, 2015, now Pat. No. 9,901,810, which is a (Continued)

(51) Int. Cl.
*A63F 1/12* (2006.01)
*A63F 1/08* (2006.01)

(52) U.S. Cl.
CPC . *A63F 1/12* (2013.01); *A63F 1/08* (2013.01)

(58) Field of Classification Search
None
See application file for complete search history.

(56) References Cited

U.S. PATENT DOCUMENTS 130,281 A 8/1872 Coughlin
205,030 A 6/1878 Ash
(Continued)

FOREIGN PATENT DOCUMENTS

AU 2383667 A 1/1969
AU 5025479 A1 3/1980
(Continued)

OTHER PUBLICATIONS

Australian Examination Report for Australian Application No. 2016277702, dated Jul. 12, 2018, 3 pages.
(Continued)

*Primary Examiner* — John E Simms, Jr.
*Assistant Examiner* — Dolores R Collins
(74) *Attorney, Agent, or Firm* — TraskBritt

(57) ABSTRACT

A playing card handling device comprises a card storing area that supports a stack of playing cards, the card storing area having a playing card support surface. A card removing system removes playing cards individually from the bottom of the stack. A pivoting arm is automatically moved by a motor between at least two positions, wherein in a first position the end of the arm opposite a pivot is disengaged from a playing card at the top of the stack and in a second position the end of the arm is engaged with a playing card at the top of the stack. A processor in the playing card handling device directs movement of the pivoting arm between at least the first and second positions when a predetermined number of cards is present in the card storing area. Methods of card handling include employing the use of such a pivotal arm.

20 Claims, 6 Drawing Sheets

Related U.S. Application Data continuation of application No. 14/077,035, filed on Nov. 11, 2013, now Pat. No. 9,220,971, which is a continuation of application No. 12/943,871, filed on Nov. 10, 2010, now Pat. No. 8,579,289, which is a continuation-in-part of application No. 11/481,407, filed on Jul. 5, 2006, now Pat. No. 8,342,525, and a continuation-in-part of application No. 11/444,167, filed on May 31, 2006, now Pat. No. 8,353,513.

(56) References Cited

U.S. PATENT DOCUMENTS

| | | | | |
|---|---|---|---|---|
| 609,730 | A | | 8/1898 | Booth |
| 673,154 | A | | 4/1901 | Bellows |
| 793,489 | A | | 6/1905 | Williams |
| 892,389 | A | | 7/1908 | Bellows |
| 1,014,219 | A | | 1/1912 | Hall |
| 1,043,109 | A | | 11/1912 | Hurm |
| 1,157,898 | A | | 10/1915 | Perret |
| 1,256,509 | A | | 2/1918 | Belknap |
| 1,380,898 | A | | 6/1921 | Hall |
| 1,992,085 | A | | 2/1925 | McKay |
| 1,556,856 | A | | 10/1925 | Lipps |
| 1,850,114 | A | | 6/1929 | McCaddin |
| 1,757,553 | A | | 5/1930 | Gustav |
| 1,885,276 | A | | 11/1932 | McKay |
| 1,889,729 | A | | 11/1932 | Hammond |
| 1,955,926 | A | | 4/1934 | Matthaey |
| 1,998,690 | A | | 4/1935 | Shepherd et al. |
| 2,001,220 | A | | 5/1935 | Smith |
| 2,001,918 | A | | 5/1935 | Nevius |
| 2,016,030 | A | | 10/1935 | Woodruff et al. |
| 2,043,343 | A | | 6/1936 | Warner |
| 2,060,096 | A | | 11/1936 | McCoy |
| 2,065,824 | A | | 12/1936 | Plass |
| 2,159,958 | A | | 5/1939 | Sachs |
| 2,185,474 | A | | 1/1940 | Nott |
| 2,254,484 | A | | 9/1941 | Hutchins |
| D132,360 | S | | 5/1942 | Gardner |
| 2,328,153 | A | | 8/1943 | Laing |
| 2,328,879 | A | | 9/1943 | Isaacson |
| D139,530 | S | | 11/1944 | Schindler |
| 2,364,413 | A | | 12/1944 | Wittel |
| 2,525,305 | A | | 10/1950 | Lombard |
| 2,543,522 | A | | 2/1951 | Cohen |
| 2,588,582 | A | | 3/1952 | Sivertson |
| 2,615,719 | A | | 10/1952 | Fonken |
| 2,659,607 | A | | 11/1953 | Skillman et al. |
| 2,661,215 | A | | 12/1953 | Stevens |
| 2,676,020 | A | | 4/1954 | Ogden |
| 2,692,777 | A | | 10/1954 | Miller |
| 2,701,720 | A | | 2/1955 | Ogden |
| 2,705,638 | A | | 4/1955 | Newcomb |
| 2,711,319 | A | | 6/1955 | Morgan et al. |
| 2,714,510 | A | | 8/1955 | Oppenlander et al. |
| 2,717,782 | A | | 9/1955 | Droll |
| 2,727,747 | A | | 12/1955 | Semisch, Jr. |
| 2,731,271 | A | | 1/1956 | Brown |
| 2,747,877 | A | | 5/1956 | Howard |
| 2,755,090 | A | | 7/1956 | Aldrich |
| 2,757,005 | A | | 7/1956 | Nothaft |
| 2,760,779 | A | | 8/1956 | Ogden et al. |
| 2,770,459 | A | | 11/1956 | Wilson et al. |
| 2,778,643 | A | | 1/1957 | Williams |
| 2,778,644 | A | | 1/1957 | Stephenson |
| 2,782,040 | A | | 2/1957 | Matter |
| 2,790,641 | A | | 4/1957 | Adams |
| 2,793,863 | A | | 5/1957 | Liebelt |
| 2,815,214 | A | | 12/1957 | Hall |
| 2,821,399 | A | | 1/1958 | Heinoo |
| 2,914,215 | A | | 11/1959 | Neidig |
| 2,937,739 | A | | 5/1960 | Levy |
| 2,950,005 | A | | 8/1960 | MacDonald |
| RE24,986 | E | | 5/1961 | Stephenson |
| 3,067,885 | A | | 12/1962 | Kohler |
| 3,107,096 | A | | 10/1963 | Osborn |
| 3,124,674 | A | | 3/1964 | Edwards et al. |
| 3,131,935 | A | | 5/1964 | Gronneberg |
| 3,147,978 | A | | 9/1964 | Sjostrand |
| D200,652 | S | | 3/1965 | Fisk |
| 3,185,482 | A | | 5/1965 | Russell |
| 3,222,071 | A | | 12/1965 | Lang |
| 3,235,741 | A | | 2/1966 | Plaisance |
| 3,288,308 | A | | 11/1966 | Gingher |
| 3,305,237 | A | | 2/1967 | Granius |
| 3,312,473 | A | | 4/1967 | Friedman et al. |
| 3,452,509 | A | | 7/1969 | Hauer |
| 3,530,968 | A | * | 9/1970 | Palmer ..... 194/210 |
| 3,588,116 | A | | 6/1971 | Miura |
| 3,589,730 | A | | 6/1971 | Slay |
| 3,595,388 | A | | 7/1971 | Castaldi |
| 3,597,076 | A | | 8/1971 | Hubbard et al. |
| 3,598,396 | A | | 8/1971 | Andrews et al. |
| 3,618,933 | A | | 11/1971 | Roggenstein et al. |
| 3,627,331 | A | | 12/1971 | Lyon, Jr. |
| 3,666,270 | A | | 5/1972 | Mazur |
| 3,680,853 | A | | 8/1972 | Houghton et al. |
| 3,690,670 | A | | 9/1972 | Cassady et al. |
| 3,704,938 | A | | 12/1972 | Fanselow |
| 3,716,238 | A | | 2/1973 | Porter |
| 3,751,041 | A | | 8/1973 | Seifert |
| 3,761,079 | A | | 9/1973 | Azure, Jr. |
| 3,810,627 | A | | 5/1974 | Levy |
| D232,953 | S | | 9/1974 | Oguchi |
| 3,861,261 | A | | 1/1975 | Maxey |
| 3,897,954 | A | | 8/1975 | Erickson et al. |
| 3,899,178 | A | | 8/1975 | Watanabe |
| 3,909,002 | A | | 9/1975 | Levy |
| 3,929,339 | A | | 12/1975 | Mattioli |
| 3,944,077 | A | | 3/1976 | Green |
| 3,944,230 | A | | 3/1976 | Fineman |
| 3,949,219 | A | | 4/1976 | Crouse |
| 3,968,364 | A | | 7/1976 | Miller |
| 4,023,705 | A | | 5/1977 | Reiner et al. |
| 4,033,590 | A | | 7/1977 | Pic |
| 4,072,930 | A | | 2/1978 | Lucero et al. |
| 4,088,265 | A | | 5/1978 | Garczynski |
| 4,151,410 | A | | 4/1979 | McMillan et al. |
| 4,159,581 | A | | 7/1979 | Lichtenberg |
| 4,162,649 | A | | 7/1979 | Thornton |
| 4,166,615 | A | | 9/1979 | Noguchi et al. |
| 4,232,861 | A | | 11/1980 | Maul |
| 4,280,690 | A | | 7/1981 | Hill |
| 4,283,709 | A | | 8/1981 | Lucero et al. |
| 4,310,160 | A | | 1/1982 | Willette et al. |
| 4,339,134 | A | | 7/1982 | Macheel |
| 4,339,798 | A | | 7/1982 | Hedges et al. |
| 4,361,393 | A | | 11/1982 | Noto |
| 4,368,972 | A | | 1/1983 | Naramore |
| 4,369,972 | A | | 1/1983 | Parker |
| 4,374,309 | A | | 2/1983 | Walton |
| 4,377,285 | A | | 3/1983 | Kadlic |
| 4,385,827 | A | | 5/1983 | Naramore |
| 4,388,994 | A | | 6/1983 | Suda et al. |
| 4,397,469 | A | | 8/1983 | Carter, III |
| 4,421,312 | A | | 12/1983 | Delgado et al. |
| 4,421,501 | A | | 12/1983 | Scheller |
| D273,962 | S | | 5/1984 | Fromm |
| D274,069 | S | | 5/1984 | Fromm |
| 4,457,512 | A | | 7/1984 | Stevenson |
| 4,467,424 | A | | 8/1984 | Hedges et al. |
| 4,494,197 | A | | 1/1985 | Troy et al. |
| 4,497,488 | A | | 2/1985 | Plevyak et al. |
| 4,512,580 | A | | 4/1985 | Matviak |
| 4,513,969 | A | | 4/1985 | Samsel, Jr. |
| 4,515,367 | A | | 5/1985 | Howard |
| 4,531,187 | A | | 7/1985 | Uhland |
| 4,534,562 | A | | 8/1985 | Cuff et al. |
| 4,549,738 | A | | 10/1985 | Greitzer |
| 4,566,782 | A | | 1/1986 | Britt et al. |
| 4,575,367 | A | | 3/1986 | Karmel |
| 4,586,712 | A | | 5/1986 | Loiter et al. |
| 4,659,082 | A | * | 4/1987 | Greenberg ..... 273/149 R |
| 4,662,637 | A | | 5/1987 | Pfeiffer |

(56) References Cited

U.S. PATENT DOCUMENTS 4,662,816 A 5/1987 Fabrig
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,412 A 9/1988 Wolfe
4,770,421 A 9/1988 Hoffman
4,807,884 A 2/1989 Breeding
4,822,050 A 4/1989 Normand et al.
4,832,342 A 5/1989 Plevyak et al.
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Royer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 LeVasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 DeMar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A * 3/1994 Lwee ..... 361/679.33
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A * 7/1995 Kelley ..... 273/149 P
5,431,407 A 7/1995 Hofberg et al.
5,437,462 A 8/1995 Breeding
5,445,377 A 8/1995 Steinbach
5,470,079 A 11/1995 LeStrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A * 12/1997 Frisco et al. ..... 273/149 R
5,695,189 A 12/1997 Breeding et al.
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A * 3/1998 Hill et al. ..... 463/47
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson
5,836,775 A * 11/1998 Hiyanna et al. ..... 439/159
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A * 8/1999 Korsunsky et al. ..... 235/441
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A * 1/2000 Benjamin et al. ..... 439/267
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.
6,071,190 A 6/2000 Weiss et al.
6,093,103 A 7/2000 McCrea, Jr.

(56) References Cited

U.S. PATENT DOCUMENTS 6,113,101 A 9/2000 Wirth
6,117,012 A 9/2000 McCrea, Jr.
D432,588 S 10/2000 Tedham
6,126,166 A 10/2000 Lorson et al.
6,131,817 A 10/2000 Miller
6,139,014 A 10/2000 Breeding et al.
6,149,154 A * 11/2000 Grauzer ..... A63F 1/12 273/149 P
6,154,131 A 11/2000 Jones, II et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block
6,386,973 B1 5/2002 Yoseloff
6,402,142 B1 6/2002 Warren et al.
6,403,908 B2 6/2002 Stardust et al.
6,443,839 B2 9/2002 Stockdale et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,561,897 B1 5/2003 Bourbour et al.
6,568,678 B2 * 5/2003 Breeding ..... A63F 1/12 273/149 R
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hard
6,585,856 B2 7/2003 Zwick et al.
6,588,750 B1 * 7/2003 Grauzer ..... A63F 1/12 273/149 P
6,588,751 B1 * 7/2003 Grauzer et al. ..... 273/149 R
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 * 10/2003 Robinson ..... 221/268
6,638,161 B2 10/2003 Soltys et al.
6,645,068 B1 11/2003 Kelly et al.
6,645,077 B2 11/2003 Rowe
6,651,981 B2 11/2003 Grauzer et al.
6,651,982 B2 11/2003 Grauzer et al.
6,651,985 B2 11/2003 Sines et al.
6,652,379 B2 11/2003 Soltys et al.
6,655,684 B2 * 12/2003 Grauzer et al. ..... 273/149 R
6,655,690 B1 12/2003 Oskwarek
6,658,135 B1 12/2003 Morito et al.
6,659,460 B2 12/2003 Blaha et al.
6,659,461 B2 12/2003 Yoseloff
6,659,875 B2 12/2003 Purton
6,663,490 B2 12/2003 Soltys et al.
6,666,768 B1 12/2003 Akers
6,671,358 B1 12/2003 Seidman et al.
6,676,127 B2 * 1/2004 Johnson ..... A63F 1/12 273/149 P
6,676,517 B2 1/2004 Beavers
6,680,843 B2 * 1/2004 Farrow et al. ..... 361/679.02
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,712,696 B2 3/2004 Soltys et al.
6,719,288 B2 4/2004 Hessing et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,749,510 B2 6/2004 Giobbi
6,758,751 B2 7/2004 Soltys et al.
6,758,757 B2 7/2004 Luciano, Jr. et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue, Jr. et al.
6,848,994 B1 2/2005 Knust et al.
6,857,961 B2 2/2005 Soltys et al.
6,874,784 B1 4/2005 Promutico et al.
6,874,786 B2 4/2005 Bruno
6,877,657 B2 4/2005 Ranard et al.
6,877,748 B1 4/2005 Patroni et al.
6,886,829 B2 5/2005 Hessing et al.

(56) References Cited

U.S. PATENT DOCUMENTS

| | | | |
|---|---|---|---|
| 6,889,979 | B2 | 5/2005 | Blaha et al. |
| 6,893,347 | B1 | 5/2005 | Zilliacus et al. |
| 6,899,628 | B2 | 5/2005 | Leen et al. |
| 6,902,167 | B2 | 6/2005 | Webb |
| 6,905,121 | B1 | 6/2005 | Timpano |
| 6,923,446 | B2 | 8/2005 | Snow |
| 6,938,900 | B2 | 9/2005 | Snow |
| 6,941,180 | B1 | 9/2005 | Fisher et al. |
| 6,950,948 | B2 | 9/2005 | Neff |
| 6,955,599 | B2 | 10/2005 | Bourbour et al. |
| 6,957,746 | B2 | 10/2005 | Martin et al. |
| 6,959,925 | B1 | 11/2005 | Baker et al. |
| 6,960,134 | B2 | 11/2005 | Hartl et al. |
| 6,964,612 | B2 | 11/2005 | Soltys et al. |
| 6,986,514 | B2 | 1/2006 | Snow |
| 6,988,516 | B2 | 1/2006 | Debaes |
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,036,818 | B2 | 5/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,059,602 | B2 | 6/2006 | Grauzer et al. |
| 7,066,464 | B2 | 6/2006 | Blad et al. |
| 7,068,822 | B2 | 6/2006 | Scott |
| 7,073,791 | B2 | 7/2006 | Grauzer et al. |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,124,947 | B2 | 10/2006 | Storch |
| 7,128,652 | B1 | 10/2006 | Lavoie et al. |
| 7,137,627 | B2 | 11/2006 | Grauzer et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,213,812 | B2 | 5/2007 | Schubert |
| 7,222,852 | B2 | 5/2007 | Soltys |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Badman |
| 7,243,148 | B2 | 7/2007 | Keir et al. |
| 7,243,698 | B2 | 7/2007 | Siegel |
| 7,246,799 | B2 | 7/2007 | Snow |
| 7,255,344 | B2 | 8/2007 | Grauzer et al. |
| 7,255,351 | B2 | 8/2007 | Yoseloff et al. |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,316,615 | B2 | 1/2008 | Soltys et al. |
| 7,322,576 | B2 | 1/2008 | Grauzer et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,565 | B2 | 5/2008 | Chiu |
| 7,367,884 | B2 | 5/2008 | Breeding et al. |
| 7,374,170 | B2 | 5/2008 | Grauzer et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,390,256 | B2 | 6/2008 | Soltys et al. |
| 7,399,226 | B2 | 7/2008 | Mishra |
| 7,407,438 | B2 | 8/2008 | Schubert et al. |
| 7,413,191 | B2 | 8/2008 | Grauzer et al. |
| 7,434,805 | B2 | 10/2008 | Grauzer et al. |
| 7,436,957 | B1 | 10/2008 | Fisher et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,537,216 | B2 | 5/2009 | Soltys et al. |
| 7,540,497 | B2 | 6/2009 | Tseng |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida |
| 7,556,266 | B2 | 7/2009 | Blaha et al. |
| 7,575,237 | B2 | 8/2009 | Snow |
| 7,578,506 | B2 | 8/2009 | Lambert |
| 7,584,962 | B2 | 9/2009 | Breeding et al. |
| 7,584,963 | B2 | 9/2009 | Krenn et al. |
| 7,584,966 | B2 | 9/2009 | Snow |
| 7,591,728 | B2 | 9/2009 | Gioia et al. |
| 7,593,544 | B2 | 9/2009 | Downs |
| 7,594,660 | B2 | 9/2009 | Baker et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,852 | B2 | 3/2010 | Baker et al. |
| 7,669,853 | B2 | 3/2010 | Jones |
| 7,677,565 | B2 | 3/2010 | Grauzer et al. |
| 7,677,566 | B2 | 3/2010 | Krenn et al. |
| 7,686,681 | B2 | 3/2010 | Soltys et al. |
| 7,699,694 | B2 | 4/2010 | Hill |
| 7,735,657 | B2 | 6/2010 | Johnson |
| 7,740,244 | B2 | 6/2010 | Ho |
| 7,744,452 | B2 | 6/2010 | Cimring et al. |
| 7,753,373 | B2 | 7/2010 | Grauzer et al. |
| 7,753,374 | B2 | 7/2010 | Ho |
| 7,753,798 | B2 | 7/2010 | Soltys |
| 7,758,425 | B2 | 7/2010 | Poh et al. |
| 7,762,554 | B2 | 7/2010 | Ho |
| 7,764,836 | B2 | 7/2010 | Downs et al. |
| 7,766,332 | B2 | 8/2010 | Grauzer et al. |
| 7,766,333 | B1 | 8/2010 | Stardust |
| 7,769,232 | B2 | 8/2010 | Downs, III |
| 7,769,853 | B2 | 8/2010 | Nezamzadeh |

(56) References Cited

U.S. PATENT DOCUMENTS 7,773,749 B1 8/2010 Durst et al.
7,780,529 B2 8/2010 Rowe et al.
7,784,790 B2 8/2010 Grauzer et al.
7,804,982 B2 9/2010 Howard et al.
7,824,255 B2 11/2010 Lutnick
7,846,020 B2 12/2010 Walker et al.
7,867,080 B2 1/2011 Nicely et al.
7,890,365 B2 2/2011 Hettinger
7,900,923 B2 3/2011 Toyama et al.
7,901,285 B2 3/2011 Tran et al.
7,908,169 B2 3/2011 Hettinger
7,909,689 B2 3/2011 Lardie
7,933,448 B2 4/2011 Downs, III
7,946,586 B2 5/2011 Krenn et al.
7,959,153 B2 6/2011 Franks, Jr.
7,967,294 B2 6/2011 Blaha et al.
7,976,023 B1 7/2011 Hessing et al.
7,931,533 B2 8/2011 LeMay et al.
7,988,152 B2 8/2011 Sines et al.
7,988,554 B2 8/2011 LeMay et al.
7,995,196 B1 8/2011 Fraser
8,002,638 B2 8/2011 Grauzer et al.
8,011,661 B2 9/2011 Stasson
8,016,663 B2 9/2011 Soltys et al.
8,021,231 B2 9/2011 Walker et al.
8,025,294 B2 9/2011 Grauzer et al.
8,038,521 B2 10/2011 Grauzer et al.
RE42,944 E 11/2011 Blaha et al.
8,057,302 B2 11/2011 Wells et al.
8,062,134 B2 11/2011 Kelly et al.
8,070,574 B2 12/2011 Grauzer et al.
8,092,307 B2 1/2012 Kelly
8,092,309 B2 1/2012 Bickley
8,109,514 B2 2/2012 Toyama
8,141,875 B2 3/2012 Grauzer et al.
8,150,158 B2 4/2012 Downs, III
8,171,567 B1 5/2012 Fraser et al.
8,210,536 B2 7/2012 Blaha et al.
8,221,244 B2 7/2012 French
8,251,293 B2 8/2012 Nagata et al.
8,267,404 B2 9/2012 Grauzer et al.
8,270,603 B1 9/2012 Durst et al.
8,287,347 B2 10/2012 Snow et al.
8,287,386 B2 10/2012 Miller et al.
8,319,666 B2 11/2012 Weinmann et al.
8,337,296 B2 12/2012 Grauzer et al.
8,342,525 B2 * 1/2013 Scheper ..... A63F 1/12 273/149 R
8,342,526 B1 1/2013 Sampson
8,342,529 B2 1/2013 Snow
8,353,513 B2 * 1/2013 Swanson ..... A63F 1/14 273/149 R
8,381,918 B2 2/2013 Johnson
8,419,521 B2 4/2013 Grauzer et al.
8,429,229 B2 4/2013 Sepich et al.
8,444,147 B2 5/2013 Grauzer et al.
8,444,489 B2 5/2013 Lian et al.
8,469,360 B2 6/2013 Sines
8,475,252 B2 7/2013 Savage et al.
8,480,088 B2 7/2013 Toyama et al.
8,485,527 B2 7/2013 Sampson et al.
8,490,973 B2 7/2013 Yoseloff et al.
8,498,444 B2 7/2013 Sharma
8,505,916 B2 8/2013 Grauzer et al.
8,511,684 B2 8/2013 Grauzer et al.
8,512,146 B2 8/2013 Gururajan et al.
8,550,464 B2 10/2013 Soltys et al.
8,556,263 B2 10/2013 Grauzer et al.
8,579,289 B2 * 11/2013 Rynda ..... A63F 1/08 273/149 R
8,602,416 B2 12/2013 Toyama
8,616,552 B2 12/2013 Czyzewski et al.
8,628,086 B2 1/2014 Krenn et al.
8,651,485 B2 2/2014 Stasson
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,710 B2 7/2014 Grauzer et al.
8,820,745 B2 9/2014 Grauzer et al.
8,844,930 B2 9/2014 Sampson
8,899,587 B2 12/2014 Grauzer et al.
8,919,775 B2 12/2014 Wadds et al.
9,101,821 B2 8/2015 Snow
9,220,971 B2 * 12/2015 Rynda ..... A63F 1/08
9,251,661 B2 2/2016 Tammesoo
9,266,012 B2 2/2016 Grauzer
9,280,866 B2 3/2016 Nayak et al.
9,378,766 B2 6/2016 Kelly et al.
9,474,957 B2 10/2016 Haushalter et al.
9,504,905 B2 11/2016 Kelly et al.
9,511,274 B2 12/2016 Kelly et al.
9,566,501 B2 2/2017 Stasson et al.
9,679,603 B2 6/2017 Kelly et al.
9,731,190 B2 8/2017 Sampson et al.
9,901,810 B2 * 2/2018 Rynda ..... A63F 1/08
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0068635 A1 6/2002 Hill
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer
2003/0047870 A1 3/2003 Blaha et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0071413 A1 4/2003 Blaha et al.
2003/0073498 A1 4/2003 Grauzer et al.
2003/0075865 A1 4/2003 Grauzer et al.
2003/0075866 A1 4/2003 Blaha et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0036214 A1 2/2004 Baker et al.
2004/0067789 A1 4/2004 Grauzer et al.
2004/0100026 A1 5/2004 Haggard
2004/0108654 A1 6/2004 Grauzer et al.
2004/0116179 A1 6/2004 Nicely et al.
2004/0169332 A1 9/2004 Grauzer et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0023752 A1 2/2005 Grauzer et al.
2005/0026680 A1 2/2005 Gururajan
2005/0035548 A1 2/2005 Yoseloff
2005/0037843 A1 2/2005 Wells et al.
2005/0040594 A1 2/2005 Krenn et al.

(56) References Cited

U.S. PATENT DOCUMENTS

| | | | |
|---|---|---|---|
| 2005/0051955 | A1 | 3/2005 | Schubert et al. |
| 2005/0051956 | A1 | 3/2005 | Grauzer et al. |
| 2005/0062227 | A1 | 3/2005 | Grauzer et al. |
| 2005/0062228 | A1 | 3/2005 | Grauzer et al. |
| 2005/0062229 | A1 | 3/2005 | Grauzer et al. |
| 2005/0082750 | A1 | 4/2005 | Grauzer et al. |
| 2005/0093231 | A1 | 5/2005 | Grauzer et al. |
| 2005/0104289 | A1 | 5/2005 | Grauzer et al. |
| 2005/0104290 | A1 | 5/2005 | Grauzer et al. |
| 2005/0110210 | A1 | 5/2005 | Soltys et al. |
| 2005/0113166 | A1 | 5/2005 | Grauzer et al. |
| 2005/0113171 | A1 | 5/2005 | Hodgson |
| 2005/0119048 | A1 | 6/2005 | Soltys |
| 2005/0121852 | A1 | 6/2005 | Soltys et al. |
| 2005/0137005 | A1 | 6/2005 | Soltys et al. |
| 2005/0140090 | A1 | 6/2005 | Breeding et al. |
| 2005/0146093 | A1 | 7/2005 | Grauzer et al. |
| 2005/0148391 | A1 | 7/2005 | Tain |
| 2005/0164759 | A1 | 7/2005 | Smith et al. |
| 2005/0164761 | A1 | 7/2005 | Tain |
| 2005/0192092 | A1 | 9/2005 | Breckner et al. |
| 2005/0206077 | A1 | 9/2005 | Grauzer et al. |
| 2005/0242500 | A1 | 11/2005 | Downs |
| 2005/0272501 | A1 | 12/2005 | Tran et al. |
| 2005/0277463 | A1 | 12/2005 | Knust et al. |
| 2005/0288083 | A1 | 12/2005 | Downs |
| 2005/0288086 | A1 | 12/2005 | Schubert et al. |
| 2006/0027970 | A1 | 2/2006 | Kyrychenko |
| 2006/0033269 | A1 | 2/2006 | Grauzer et al. |
| 2006/0033270 | A1 | 2/2006 | Grauzer et al. |
| 2006/0046853 | A1 | 3/2006 | Black |
| 2006/0063577 | A1 | 3/2006 | Downs, III et al. |
| 2006/0066048 | A1 | 3/2006 | Krenn et al. |
| 2006/0084502 | A1 | 4/2006 | Downs et al. |
| 2006/0151946 | A1 | 7/2006 | Ngai |
| 2006/0181022 | A1 | 8/2006 | Grauzer et al. |
| 2006/0183540 | A1 | 8/2006 | Grauzer et al. |
| 2006/0189381 | A1 | 8/2006 | Daniel et al. |
| 2006/0199649 | A1 | 9/2006 | Soltys et al. |
| 2006/0205508 | A1 | 9/2006 | Green |
| 2006/0220312 | A1 | 10/2006 | Baker et al. |
| 2006/0220313 | A1 | 10/2006 | Baker et al. |
| 2006/0252521 | A1 | 11/2006 | Gururajan et al. |
| 2006/0252554 | A1 | 11/2006 | Gururajan et al. |
| 2006/0279040 | A1 | 12/2006 | Downs et al. |
| 2006/0281534 | A1 | 12/2006 | Grauzer et al. |
| 2007/0001395 | A1 | 1/2007 | Gioia et al. |
| 2007/0006708 | A1 | 1/2007 | Laakso |
| 2007/0015583 | A1 | 1/2007 | Tran |
| 2007/0018389 | A1 | 1/2007 | Downs, III |
| 2007/0045959 | A1 | 3/2007 | Soltys |
| 2007/0049368 | A1 | 3/2007 | Kuhn et al. |
| 2007/0057454 | A1 | 3/2007 | Fleckenstein |
| 2007/0057469 | A1 | 3/2007 | Grauzer et al. |
| 2007/0066387 | A1 | 3/2007 | Matsuno et al. |
| 2007/0069462 | A1 | 3/2007 | Downs, III et al. |
| 2007/0072677 | A1 | 3/2007 | Lavoie et al. |
| 2007/0102879 | A1 | 5/2007 | Stasson |
| 2007/0111773 | A1 | 5/2007 | Gururajan et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0241498 | A1 | 10/2007 | Soltys |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0278739 | A1 | 12/2007 | Swanson |
| 2007/0287534 | A1 | 12/2007 | Fleckenstein |
| 2007/0290438 | A1 | 12/2007 | Grauzer et al. |
| 2007/0298865 | A1 | 12/2007 | Soltys |
| 2008/0004107 | A1 | 1/2008 | Nguyen et al. |
| 2008/0006997 | A1 | 1/2008 | Scheper et al. |
| 2008/0006998 | A1 | 1/2008 | Grauzer et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | LeMay et al. |
| 2008/0111300 | A1 | 5/2008 | Czyzewski et al. |
| 2008/0113700 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0303210 | A1 | 12/2008 | Grauzer et al. |
| 2008/0315517 | A1 | 12/2008 | Toyama et al. |
| 2009/0026700 | A2 | 1/2009 | Shigeta |
| 2009/0048026 | A1 | 2/2009 | French |
| 2009/0054161 | A1 | 2/2009 | Schuber et al. |
| 2009/0072477 | A1 | 3/2009 | Tseng et al. |
| 2009/0121429 | A1 | 3/2009 | Walsh et al. |
| 2009/0091078 | A1 | 4/2009 | Grauzer et al. |
| 2009/0100409 | A1 | 4/2009 | Toneguzzo |
| 2009/0104963 | A1 | 4/2009 | Burman |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh et al. |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0189346 | A1 | 7/2009 | Krenn et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267296 | A1 | 10/2009 | Ho et al. |
| 2009/0267297 | A1 | 10/2009 | Blaha et al. |
| 2009/0283969 | A1 | 11/2009 | Tseng et al. |
| 2009/0298577 | A1 | 12/2009 | Gagner et al. |
| 2009/0302535 | A1 | 12/2009 | Ho et al. |
| 2009/0302537 | A1 | 12/2009 | Ho et al. |
| 2009/0312093 | A1 | 12/2009 | Walker et al. |
| 2009/0314188 | A1 | 12/2009 | Toyama et al. |
| 2010/0013152 | A1 | 1/2010 | Grauzer |
| 2010/0038849 | A1 | 2/2010 | Scheper et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0244382 | A1 | 9/2010 | Snow |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer |
| 2011/0006480 | A1 | 1/2011 | Grauzer |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta |
| 2011/0078096 | A1 | 3/2011 | Bounds |
| 2011/0079959 | A1 | 4/2011 | Hartley |
| 2011/0105208 | A1 | 5/2011 | Bickley |
| 2011/0109042 | A1 | 5/2011 | Rynda |

(56) References Cited

U.S. PATENT DOCUMENTS

| | | | |
|---|---|---|---|
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer |
| 2012/0181747 | A1 | 7/2012 | Grauzer et al. |
| 2012/0187625 | A1 | 7/2012 | Downs, III et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0085638 | A1 | 4/2013 | Weinmann et al. |
| 2013/0099448 | A1 | 4/2013 | Scheper et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2015/0021242 | A1 | 1/2015 | Johnson |
| 2015/0069699 | A1 | 3/2015 | Blazevic |
| 2015/0196834 | A1 | 7/2015 | Snow |
| 2015/0238848 | A1 | 8/2015 | Kuhn et al. |
| 2015/0251079 | A1 | 9/2015 | Wright |
| 2017/0157499 | A1 | 6/2017 | Krenn et al. |
| 2018/0200610 | A1 | 7/2018 | Riordan et al. |

FOREIGN PATENT DOCUMENTS

| | | | |
|---|---|---|---|
| AU | 697805 | B2 | 10/1998 |
| AU | 757636 | B2 | 2/2003 |
| CA | 2266555 | A1 | 9/1996 |
| CA | 2284017 | A1 | 9/1998 |
| CA | 2612138 | A1 | 12/2006 |
| CN | 2051521 | U | 1/1990 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 1771077 | B | 6/2010 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CZ | 24952 | U1 | 2/2013 |
| DE | 0291230 | C | 4/1916 |
| DE | 2816377 | A1 | 10/1979 |
| DE | 3807127 | A1 | 9/1989 |
| DE | 2757341 | A1 | 9/1998 |
| EP | 0777514 | B1 | 2/2000 |
| EP | 1502631 | A1 | 2/2005 |
| EP | 1713026 | A1 | 10/2006 |
| EP | 1194888 | A1 | 8/2009 |
| EP | 2228106 | A1 | 9/2010 |
| EP | 1575261 | B1 | 8/2012 |
| FR | 2375918 | A1 | 7/1978 |
| GB | 289552 | A | 4/1928 |
| GB | 337147 | A | 9/1929 |
| GB | 414014 | A | 7/1934 |
| GB | 672616 | A | 5/1952 |
| JP | 10063933 | A | 3/1998 |
| JP | 11045321 | A | 2/1999 |
| JP | 2000251031 | A | 9/2000 |
| JP | 2001327647 | A | 11/2001 |
| JP | 2002165916 | A | 6/2002 |
| JP | 2003-154320 | A | 5/2003 |
| JP | 2003250950 | A | 9/2003 |
| JP | 2005198668 | A | 7/2005 |
| JP | 2006-092140 | A | 4/2006 |
| JP | 2008246061 | A | 10/2008 |
| JP | 4586474 | B2 | 11/2010 |
| TW | M335308 | U | 7/2008 |
| TW | M357307 | U | 5/2009 |
| TW | M359356 | U | 6/2009 |
| TW | I345476 | B | 7/2011 |
| WO | 8700764 | A1 | 2/1987 |
| WO | 9221413 | A1 | 12/1992 |
| WO | 9528210 | A1 | 10/1995 |
| WO | 9607153 | A1 | 3/1996 |
| WO | 9710577 | A1 | 3/1997 |
| WO | 9814249 | A1 | 4/1998 |
| WO | 9840136 | A1 | 9/1998 |
| WO | 9943404 | A1 | 9/1999 |
| WO | 9952610 | A1 | 10/1999 |
| WO | 9952611 | A1 | 10/1999 |
| WO | 200051076 | A1 | 8/2000 |
| WO | 156670 | A1 | 8/2001 |
| WO | 178854 | A3 | 10/2001 |
| WO | 205914 | A1 | 1/2002 |
| WO | 3026763 | A1 | 4/2003 |
| WO | 2004067889 | A1 | 12/2004 |
| WO | 2004112923 | A1 | 12/2004 |
| WO | 2006031472 | A2 | 3/2006 |
| WO | 2006039308 | A2 | 4/2006 |
| WO | 3004116 | A1 | 11/2007 |
| WO | 2008005286 | A2 | 1/2008 |
| WO | 2008006023 | A2 | 1/2008 |
| WO | 2008091809 | A2 | 7/2008 |
| WO | 2009067758 | A1 | 6/2009 |
| WO | 2009137541 | A2 | 11/2009 |
| WO | 2010052573 | A2 | 5/2010 |
| WO | 2010055328 | A2 | 5/2010 |
| WO | 2010117446 | A2 | 10/2010 |
| WO | 2012/053074 | A1 | 4/2012 |

(56) References Cited

FOREIGN PATENT DOCUMENTS

| | | | |
|---|---|---|---|
| WO | 2013019677 | A2 | 2/2013 |
| WO | 2016058085 | A9 | 4/2016 |

OTHER PUBLICATIONS

Shuffle Master, Inc. (1996). Let It Ride, The Tournament, User Guide, 72 pages.
Philippines Patent Application Formality Examination Report—Philippines Patent Application No. 1-2006-000302, dated Jun. 13, 2006.
"Playtech Retail begins roll out of Neon across Grosvenos 55 UK Casinos". Playtech, Apr. 21, 2016. Retrieved on Oct. 11, 2016 from the Internet: <URL: https://www.playtech.com/news/latest_news_and_prs/playtech_retail_begins_roll_out_of neon_across_grosvenor_s_55_uk_casinos> (1 page).
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Scarne's Encyclopedia of Games by John Scame, 1973, "Super Contract Bridge", p. 153.
Shuffle Master Gaming, Service Manual, ACETM Single Deck Card Shuffler, (1998), 63 pages.
Shuffle Master Gaming, Service Manual, Let It Ride Bonus® With Universal Keypad, 112 pages, © 2000 Shuffle Master, Inc.
Service Manual/User Manual for Single Deck Shufflers: BG1, BG2 and BG3 by Shuffle Master © 1997, 151 page.
Singapore Patent Application Examination Report—Singapore Patent Application No. SE 2008 01914 A, Jun. 18, 2008, 9 pages.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master's Reply Memorandum in Support of Shuffle Master's Motion for Preliminary Injunction for *Shuffle Master, Inc.* vs. *VendingData Corporation*, in the U.S. District Court, District of Nevada, No. CV-S-04-1373-JCM-LRL, Nov. 29, 2004.
Statement of Relevance of Cited References, Submitted as Part of a Third-Party Submission Under 37 CFR 1.290 on Dec. 7, 2012 (12 pages).
"TableScanner (TM) from ADVANSYS", Casino Inside Magazine, No. 30, pp. 34-36 (Dec. 2012) (4 pages).
TableScanner "Accounting & Cage". Product Information Datasheets [online]. Advansys, 2013. Retrieved on Oct. 11, 2016 from the Internet: <URL: http://advansys.si/products/tablescanner/accounting-cage/> (4 pages).
TableScanner "Casino Management System". Product Information Datasheets [online]. Advansys, 2013. Retrieved on Oct. 11, 2016 from the Internet: <URL: http://advansys.si/> (6 pages).
TableScanner "Multisite". Product Information Datasheets [online]. Advansys, 2013. Retrieved on Oct. 11, 2016 from the Internet: <URL: http://advansys.si/products/tablescanner/multisite/> (3 pages).
TableScanner "Player Tracking". Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system". Product Information Datasheets [online]. Advansys, 2013. Retrieved on Oct. 11, 2016 from the Internet: <URL: http://advansys.si/products/tablescanner/> (4 pages).
Tbm=pts&hl=en Google Search for card handling device with storage area, card removing system pivoting arm and processor http://www.google.com/?tbrn=pts&hl=en; Jul. 28, 2012, 2 pages.
Tracking the Tables, by Jack Bularsky, Casino Journal, May 2004, vol. 17, No. 5, pp. 44-47.
"TYM @ A Glance—Table Games Yield Management", TYM Live Product Information Datasheets [online]. TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, in the U.S. District Court, District of Nevada, No. CV-S-04-1373-JCM-LRL, Oct. 25, 2004.
VendingData Corporation's Opposition to Shuffle Master, Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, Inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.
*Shuffle Tech International LLC et al.* vs. *Scientific Games Corporation et al.*, Order Denying Motion for Summary Judgement: Memorandum Opinion and Order, in the U.S. District Court, for the Northern District of Illinois Eastern Division, No. 15 C 3702, Sep. 1, 2017, 35 pages.
Macau Office Action and Search Report from Macau Application No. Jan. I/1128, dated Dec. 27, 2018, 18 pages.
⅓" B/W CCD Camera Module EB100 by EverFocus Electronics Corp., Jul. 31, 2001, 3 pgs.
"ACE, Single Deck Shuffler," Shuffle Master, Inc., (2005), 2 pages.
ADVANSYS, "Player Tracking" http://advansys.si/products/tablescanner/player-tracking/[Sep. 23, 2016 1:41:34 PM], 4 pages.
Australian Examination Report for Australian Application No. 2016277698, dated Feb. 6, 2018, 4 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Provisional Patent Application for Australian Patent Application No. PM7441, filed Aug. 15, 1994, Applicants: Rodney G. Johnson et al., Title: Card Handling Apparatus, 13 pages.
"Automatic casino card shuffle," Alibaba.com, (last visited Jul. 22, 2014), 2 pages.
Bally Systems Catalogue, Ballytech.com/systems, 2012, 13 pages.
Canadian Office Action for Canadian Application No. 2816708, dated Sep. 1, 2017, 4 pages.
Chinese Office Action and Search Report from Chinese Application No. 201610321919.X, dated Mar. 24, 2017, 9 pages.
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 18 of 23 (color copies from Binder 1).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 3 of 23 (Binder 2, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 19 of 23 (color copies from Binder 3).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 5 of 23 (Binder 3, 1 of 2).

(56) References Cited

OTHER PUBLICATIONS

Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 20 of 23 (color copies from Binder 4).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 21 of 23 (color copies from Binder 6).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6,1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 22 of 23 (color copies from Binder 8, part 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
DVD labeled Exhibit 1. This is a DVD taken by Shuffle Master personnel of the live operation of a CARD One2Sil Shuffler (Oct. 7, 2003). DVD sent to Examiner by US Postal Service with copy of this PTO/SB/08 form.
DVD labeled Morrill Decl. Ex. A is (see Binder 4-1, p. 149/206, Morrill Decl., para. 2.): A video (16 minutes) that the attorney for CARD, Robert Morrill, made to describe the Roblejo prototype card shuffler. DVD sent to Examiner by US Postal Service with copy of this PTO/SB/08 form.
DVD labeled Solberg Decl.Ex.C, which is not a video at all, is (see Binder 4-1, p. 34/206, Solberg Decl., para.8): Computer source code for operating a computer-controlled card shuffler (an early Roblejo prototype card shuffler) and descriptive comments of how the code works. DVD sent to Examiner by US Postal Service with copy of this PTO/SB/08 form.
DVD labeled Luciano Decl. Ex. K is (see Binder 2-1, p. 215/237, Luciano Decl., para.14): A video demonstration (11minutes) of a Luciano Packaging prototype shuffler. DVD sent to Examiner by US Postal Service with copy of this PTO/SB/08 form.
"Error Back propagation," http://willamette.edu~gorr/classes/cs449/backprop.html (4 pages), Nov. 13, 2008.
"I-Deal," Bally Technologies, Inc., (2014), 2 pages.
"Shufflers—SHFL entertainment," Gaming Concepts Group, (2012), 6 pages.
"TAG Archives: Shuffle Machine," Gee Wiz Online, (Mar. 25, 2013), 4 pages.
Australian Examination Report for Australian Application No. 2016277702, dated Mar. 16, 2018, 4 pages.
U.S. Appl. No. 15/276,476, filed Sep. 26, 2016, titled "Devices, Systems, and Related Methods for Real-Time Monitoring and Display of Related Data for Casino Gaming Devices", to Nagaragatta et al., 36 pages.
U.S. Appl. No. 15/365,610, filed Nov. 30, 2016, titled "Card Handling Devices and Related Assemblies and Components", to Helsen et al., 62 pages.
Weisenfeld, Bernie; Inventor betting on shuffler; Courier-Post; Sep. 11, 1990; 1 page.
Solberg, Halvard; Deposition; *Shuffle Tech International* v. *Scientific Games Corp., et al.* 1:15-cv-3702 (N.D. III.) Oct. 18, 2016; pp. 187, 224-246, 326-330, 338-339, 396; Baytowne Reporting; Panama City, FL.
Prototype Glossary and Timelines; *Shuffle Tech International* v. *Scientific Games Corp., et al.* 1:15-cv-3702 (N.D. III.); undated; pp. 1-4.
Olsen, Eddie; Automatic Shuffler 'ready' for Atlantic City experiment; Blackjack Confidential; Jul./Aug. 1989; pp. 6-7.
Gros, Roger; New Card Management System to Be Tested At Bally's Park Place; Casino Journal; Apr. 1989; 5 pages.
Gola, Steve; Deposition; *Shuffle Tech International* v. *Scientific Games Corp.*, et al. 1:15-cv-3702 (N.D. III.); Oct. 13, 2016; pp. 1, 9-21, 30-69, 150-167, 186-188, 228-231, 290-315, 411; Henderson Legal Services, Inc.; Washington, DC.
Canadian Office Action for CA 2,580,309 dated Mar. 20, 2012 (6 pages).
Canadian Office Action for Canadian Application No. 2,461,726, dated Jul. 19, 2010, 3 pages.
Canadian Office Action for Canadian Application No. 2,461,726, dated Dec. 11, 2013, 3 pages.
CasinoTrac TableTrac Services. Product Information Datasheet [online]. CasinoTrac, 2015. Retrieved on Oct. 12, 2016 from the Internet: <URL: http://www.tabletrac.com/?pageid=15#prettyPhoto> (3 pages).
Christos Stergiou and Dimitrios Siganos, "Neural Networks," http://www.doc.ic.ac.uk/~nd/surprise_96/journal/vol4/cs11/report.html (13 pages), Dec 15, 2011.
Complaint filed in the matter of *SHFL entertainment, in.* v. *DigiDeal Corporation,* U.S. District Court, District of Nevada, Civil Action No. CV 2:12-cv-01782-GMC-VCF, Oct. 10, 2012, 62 pages.
CONNECT2TABLE Administrator Manual, Jan. 7, 2013 (82 pages).
CONNECT2TABLE Quick Installation Guide, Feb. 20, 2013 (36 pages).
CONNECT2TABLE Connect2Table System Summary, generated Oct. 21, 2016 (2 pages).

(56) References Cited

OTHER PUBLICATIONS

CONNECT2TABLE User Manual, Feb. 7, 2013 (35 pages).
European Search Report for European Application No. 12 152 303, dated Apr. 16, 2012, 3 pages.
European Patent Application Search Report—European Patent Application No. 06772987.1, dated Dec. 10, 2009, 5 pages.
European Examination Report for European Application No. 02 780 410, dated Jan. 25, 2010, 5 pages.
European Examination Report for European Application No. 02 780 410, dated Aug. 9, 2011, 4 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-tables> (4 pages).
Genevieve Orr, CS-449: Neural Networks Willamette University, http://www.willamette.edu/~gorr/classes/cs449/intro.html (4 pages), Fall 1999.
http://www.google.com/search?tbm=pts&q=Card+handling+devicve+with+input+and+outpu.. Jun. 8, 2012.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=shuftling+zone+onOopposite+site+of+input+. . . Jul. 18, 2012.
Litwiller, Dave, CCD vs. CMOS: Facts and Fiction reprinted from Jan. 2001 Issue of Photonics Spectra, Laurin Publishing Co. Inc. (4 pages).
Malaysian Patent Application Substantive Examination Adverse Report—Malaysian Patent Application Serial No. PI20062710, dated May 9, 2009, 4 pages.
Neon Product Information Datasheets [online]. "Enterprise Casino Management, Table Management System, Mobile, Gaming". Intelligent Gaming, 2014. Retrieved on Oct. 12, 2016 from the Internet: <URL: http://www.intelligentgaming.co.uk/products/neon-enterprise/> (4 pages).
PCT International Preliminary Examination Report for International Patent Application No. PCT/US02/31105 dated Jul. 28, 2004, 9 pages.
PCT International Search Report for International Application No. PCT/US2003/015393, dated Oct. 6, 2003, 2 pages.
PCT International Search Report and Written Opinion, PCT/US2012/48706, dated Oct. 16, 2012, 12 pages.
PCT International Search Report for PCT/US2005/034737 dated Apr. 7, 2006, 1 page. (WO06/039308).
PCT International Search Report for PCT/US2007/022894, dated Jun. 11, 2008, 3 pages.
PCT International Search Report and Written Opinion of the International Searching Authority for PCT/US2010/001032, dated Jun. 16, 2010, 11 pages.
PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion, PCT Application No. PCT/US2015/051038, dated Jan. 22, 2016, 11 pages.
PCT International Search Report and Written Opinion of the International Searching Authority for PCT/US2008/007069, dated Sep. 8, 2008, 10 pages.
PCT International Search Report and Written Opinion, PCT Application No. PCT/US2015/022158, dated Jun. 17, 2015, 13 pages.
PCT International Search Report and Written Opinion for International Application No. PCT/US2007/023168, dated Sep. 12, 2008, 8 pages.
PCT International Search Report and Written Opinion, PCT Application No. PCT/US2015/040196, dated Jan. 15, 2016, 20 pages.
PCT International Search Report and Written Opinion, PCT Application No. PCT/US2013/062391, dated Dec. 17, 2013, 13 pages.
PCT International Search Report and Written Opinion of the International Searching Authority for PCT/US05/31400, dated Sep. 25, 2007, 12 pages.
PCT International Search Report and Written Opinion, PCT Application No. PCT/US2015/025420, dated Oct. 2, 2015, 15 pages.
PCT International Search Report and Written Opinion of the International Searching Authority for PCT/US13/59665, dated Apr. 25, 2014, 21 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US11/59797, dated Mar. 27, 2012, 14 pages.
PCT International Search Report and Written Opinion for International Application No. PCT/US2007/022858, dated Mar. 7, 2008, 7 pages.
PCT International Search Report and Written Opinion for International Patent Application No. PCT/US2006/22911, dated Jun. 1, 2007, 6 pages.
PCT International Search Report and Written Opinion of the International Searching Authority for PCT/GB2011/051978, dated Jan. 17, 2012, 11 pages.
European Search Report and Written Opinion from European Application No. 18150584.3, dated May 2, 2018, 9 pages.
Notice of Preliminary Rejection from Korean Application No. 10-2013-7012032, dated Apr. 9, 2018, 8 pages with English translation.

* cited by examiner

PLAYING CARD HANDLING DEVICES AND RELATED METHODS

CROSS-REFERENCE TO RELATED APPLICATIONS

This application is a continuation of U.S. patent application Ser. No. 14/939,462, filed Nov. 12, 2015, now U.S. Pat. No. 9,901,810, issued Feb. 27, 2018, which is a continuation of U.S. patent application Ser. No. 14/077,035, filed Nov. 11, 2013, now U.S. Pat. No. 9,220,971, issued Dec. 29, 2015, which is a continuation of U.S. patent application Ser. No. 12/943,871, filed Nov. 10, 2010, now U.S. Pat. No. 8,579,289, issued Nov. 12, 2013, which in turn, is a continuation-in-part of two applications, U.S. patent application Ser. No. 11/481,407, filed Jul. 5, 2006, now U.S. Pat. No. 8,342,525, issued Jan. 1, 2013, and U.S. patent application Ser. No. 11/444,167, filed May 31, 2006, now U.S. Pat. No. 8,353,513, issued Jan. 15, 2013, the disclosure of each of which is hereby incorporated herein in its entirety by reference.

TECHNICAL FIELD

The present invention relates to playing card handling systems, particularly card handling systems for shuffling devices that may be used in a casino or card club environment, and particularly playing card shuffling devices that individually move a lowermost card in a stack from one area of the card handling system to another area of the card handling system.

BACKGROUND

Known card feeding systems in a card handling device may include a support surface with pick-off roller(s) that are located within the support surface to remove one card at a time from the bottom of a vertically oriented stack of cards. In this orientation, each card face is in a substantially horizontal plane with the face of a card contacting a back of an adjacent card. The weight of a stack of cards ordinarily provides a sufficient force against the rollers to assure proper movement of most of the cards. But as the stack size decreases after most of the cards have been delivered, the weight of the cards may no longer be sufficient, especially with the last few remaining cards in the stack to assure proper movement of the cards.

U.S. Pat. No. 5,692,748 to Frisco et al. describes a card shuffling device containing free-swinging weights on pivoting arms that applies pressure to the top of stacks of cards that are to be mixed. The lowest card in each stack is in contact with a feed roller that propels the card horizontally, one at a time into a center mixing chamber. As described in Frisco, each of the first and second chambers 34, 36 has an arm 52 pivotally mounted at one end by a pivot 54 to the housing 12 and having at the other end a foot 56. As described therein, when cards are cut and deposited into the first and second chambers 34, 36, the arms 52 pivot as the cards 30 are urged over the front barriers 42 into their nested positions in the first and second chambers 34, 36. As nested on the floors 40 of the first and second chambers 34, 36, the arms 52 remain in contact with the top of the cards 30 to impose a vertical load on the cards 30 to urge them to be contacted by the wheels 48*a*, 48*b*. Proximate the foot 56 of each arm 52, a weight 58 is provided on each of the arms 52. These weights on pivoting arms apply pressure through the stack(s) of cards to assure traction against a pick-off roller at the bottom of the stack.

U.S. Pat. Nos. 6,655,684, 6,588,751, 6,588,750 and 6,149,154 to Grauzer et al.; U.S. Pat. Nos. 6,568,678 and 6,325,373 to Breeding et al.; and U.S. Pat. No. 6,254,096 to Grauzer describe a shuffler having a "free-floating," rolling weight that slides along a declining card support surface, toward a set of feed rollers to provide increased force on the rollers to assist in advancing cards. The references also disclose sensors for detecting the presence of cards in a delivery tray or elsewhere.

U.S. Pat. No. 6,637,622 to Robinson describes a card delivery device with a weighted roller for assisting in card removal. A weighted cover is provided on the delivery end of the dealing shoe, covering the next card to be delivered.

U.S. Pat. No. 5,722,893 to Hill et al. describes the use of a weighted block for urging cards toward a discharge end of a shoe. The block provides a force against the cards. The block triggers a sensor when the shoe is empty. The reference specifically states: "In operation, a wedge-shaped block mounted on a heavy stainless steel roller (not shown) in a first position indicates that no cards are in the shoe. When the cards are placed in the shoe, the wedge-shaped block will be placed behind the cards and it and the cards will press against the load switch."

U.S. Pat. No. 5,431,399 to Kelley describes a bridge hand forming device in which cards are placed into an infeed area and are randomly distributed or distributed in a predetermined manner into four separate receiving trays. A weight is shown placed over the cards in the infeed area.

It would be desirable to provide structures and methods to apply a force to individually fed cards to assure consistent feeding, but only when the weight of the stack of cards is insufficient to provide adequate contact with the card feeder to consistently feed cards. It would be desirable for such a mechanism to be retractable as to not interfere with card loading. It would also be desirable to provide a structure and methods that assist in temporarily retaining cards in a position that enables consistent and accurate card handling.

BRIEF SUMMARY

The present invention is a card weight that is pivotally engaged to a structure of a card handling device to provide force against the top of a vertically disposed stack of cards. In a preferred form of the invention, the card weight engages a top card in the stack only when the weight of the stack becomes insufficient to provide adequate contact between the lowermost card in the stack and a card feeder to assure accurate card feeding. A processor determines when the weight engages a top card and controls a drive mechanism that applies a force to the top card, and maintains the force as the cards are fed. Pivoting arms of the present invention may be pivotally mounted to a stationary portion of the card handling device, such as a support frame, or may be mounted to movable components, such as a support structure on a movable elevator that maintains a vertical alignment of a stack of cards as the card stack is lowered into position for shuffling.

Devices of the present invention are particularly useful in assuring accurate feeding of cards from a card feeding area into another area of the device. In some embodiments, pivotal arms of the present invention are integrated into the card shuffling structure, preventing unwanted movement of cards while the cards are being temporarily stored or suspended during shuffling.

Movable weights of the present invention are provided in the form of pivoting arms, and are preferably motor-driven. Sensors used in association with movable weights of the present invention provide signals indicating at least one of a number of cards remaining in the card feeding area, a number of cards fed, weight position, an absence of cards, a presence of cards, a percent shuffle completion or combinations thereof.

In one form of the invention, the weighted arm is retractable. Retractable weights in a retracted position advantageously move out of the card storing area, and avoid interfering with card loading and/or positioning of the cards.

Movable weights may be pivotally attached at a point significantly below the elevation of the top of a complete stack of cards in a card input area of the device. For example, if the card handling device is a multiple deck shuffler, a complete stack of cards might be a six- or eight-deck stack. Activation of a driving mechanism that causes the weight to engage a top card is preferably made in response to an indication of a number of cards left in the card storing area, a number of cards fed from the card storing area, a height of the stack of cards remaining in the card storing area, a percentage feeding completion, a percent shuffle completion or combinations thereof. In this manner, the movable weight is only used when the stack height is smaller, and the weight of the cards can no longer provide a sufficient force between the lowest card in the stack and the feed rollers to assure accurate feeding of individual cards. In one form of the invention, the pivoting arm is driven during card feeding so that an approximately constant force remains on the cards as they are fed.

In some embodiments, pivotal arms are used to retain groups of cards in other storing areas within the card handling device. For example, when cards are shuffled by randomly selecting a point in a vertical stack of cards, gripping cards above the selected point, lowering cards and/or the elevator below the selected point and inserting cards into a gap created beneath the gripped cards, a pivotal arm may be used to prevent cards from popping upwardly out of the grippers. Pivotal arms prevent unwanted movement of cards but normally only contact cards that are moving in an unwanted manner.

A method of handling playing cards is disclosed. The method comprises the step of positioning a vertically disposed stack of playing cards into a card storing area of a card handling device. A card moving system is provided. The card moving system moves cards individually out of the card storing area and into a second area from the bottom of the stack. According to the method, at least one parameter is measured, the at least one parameter is selected from the group consisting of: a number of cards fed from the card storing area, a number of cards remaining in the card storing area, a height of the stack of cards in the card storing area, a percentage feeding completion, or a percentage shuffle completion. When a predetermined value of a parameter is measured, the method includes providing a force to an uppermost card in the stack in the card storing area, increasing a force between a lowest card in the stack and the card moving system.

A method of handling playing cards is disclosed. The method comprises a step of positioning a plurality of stacked cards in a card handling area of a card handling device. The method also includes the steps of selecting a location to divide the stacked cards and creating a gap in the stacked cards at the selected location by suspending all cards above the selected location in the stacked cards. When a number of suspended cards is at or below a predetermined number, the method includes rotating a pivotal arm so that the arm is positioned proximate to and above a top card in the suspended cards to prevent cards from moving out of suspension.

DETAILED DESCRIPTION

Figure 1:
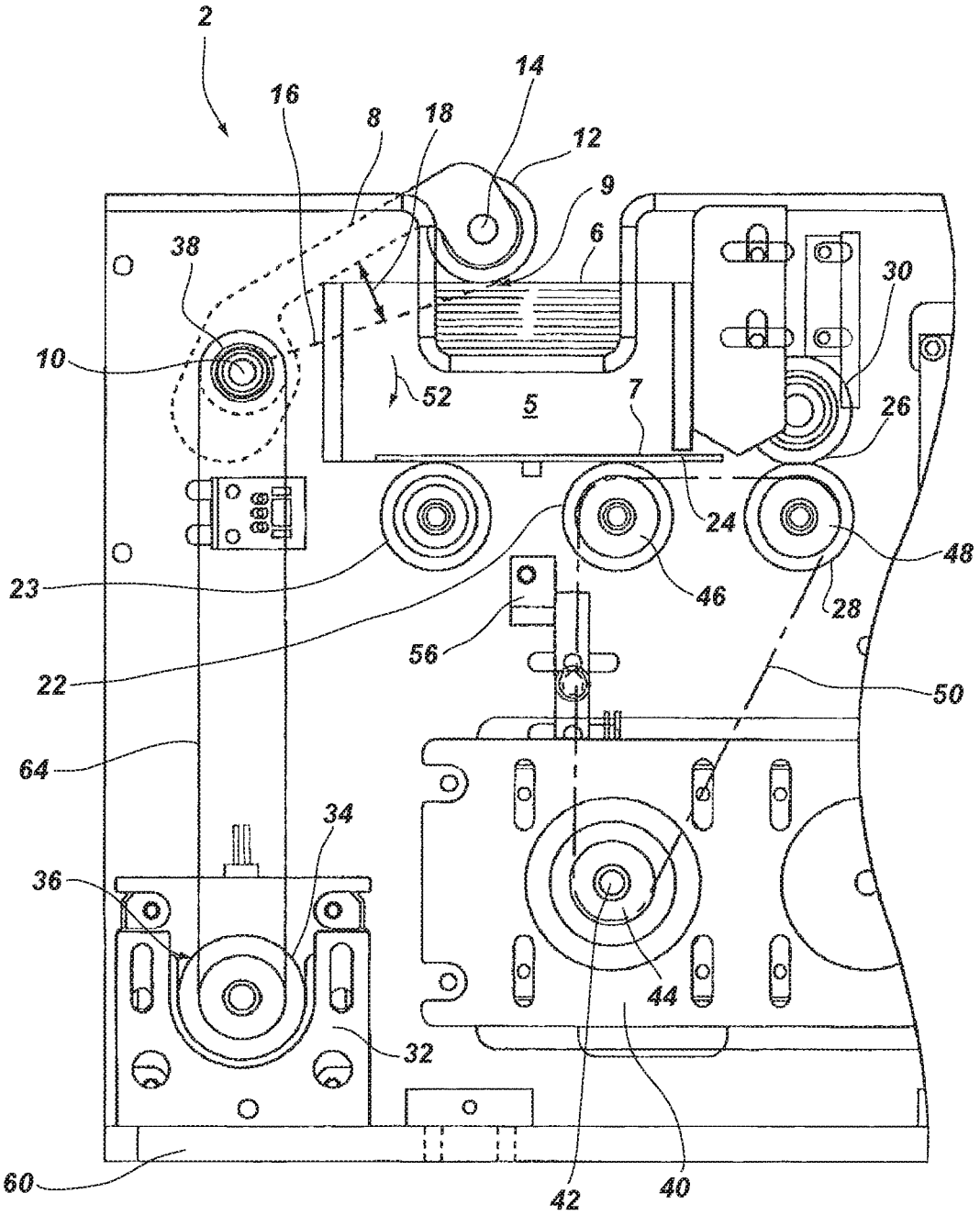
FIG. 1 shows a first side elevational view of a first exemplary card handling system of the present invention.

Playing card handling devices of the present invention are disclosed. The device comprises a card storing area that supports a stack of playing cards, the card storing area having a playing card support surface. The playing card handling device has a card removing system that removes playing cards individually from the bottom of the stack. A pivoting arm is automatically moved by a motor between at least two positions, wherein in a first position the end of the arm opposite a pivot is disengaged from a playing card at the top of the stack and in a second position the end of the arm is engaged with a playing card at the top of the stack. The device also includes a processor that directs movement of the pivoting arm between at least a first and second position when information is known to the processor that a predetermined number of cards is present in the card storing area of the card handling device. The processor additionally controls a drive mechanism, such as a stepper motor, to continue to move the pivotal weight in a manner that retains a force on the cards as the cards are fed.

Card handling devices of the present invention may include card dispensing shoes, automatic card shufflers, card set verification devices, card marking devices, card decommissioning devices, card sorting and packing devices and any other type of known card handling device. A card shuffling system may be present within the playing card handling device.

Pivotal weights of the present invention may be positioned in the card infeed area of a card handling device. A preferable movable weight is a pivotally mounted pivoting arm. Card storing areas may comprise card infeed areas for inserting cards. Other card storing areas may be intermediate storage areas within the card handling device. For example, when the card handling device is a shuffler, one or more temporary card storing areas may be located within the card shuffler.

In one embodiment of the invention, the processor causes the pivoting arm to rotate into a card contacting position when a predetermined number of between 8 and 20 cards remain in the card storage area. Prior to delivering the last 8 to 20 cards, the pivoting arm remains disengaged from the top card in the stack. It is to be understood that the weight continues to rotate during card feeding to maintain a force between the cards and a card feeder.

In some embodiments, the card handling device includes a card removing system and the card removing system comprises a pick-off roller. The movement of the pivoting arm into the engaged position applies pressure against a playing card at the top of the stack and also provides force between a lowest playing card in the stack and the pick-off roller during card feeding. Card handling devices of the present invention may include one or more sensors to measure at least a position or a degree of rotational position of the pivoting arm, or the number of cards fed, a number of cards remaining, a percent shuffle completion, and the like. Devices of the present invention may alternatively include a counter for maintaining a count of playing cards in the playing card storing area during operation of the device.

Card handling devices of the present invention are processor controlled. The processor may cause the pivoting arm to pivot into an engaged position when a card count reaches a predetermined threshold amount, such as between 8 and 20 cards, and preferably about 10 cards. The processor of examples of the invention may be in communication with at least one sensor. For example, a card present sensor in a discharge tray or a pivoting arm position sensor may provide signals to the processor and use the signals to determine when to activate the pivoting arm, or the processor is in communication with a device that counts cards fed, or cards remaining in the infeed tray.

Playing card handling devices of the present invention may include a shuffling system within the playing card handling device, wherein the shuffling system comprises a playing card collection area where cards are moved individually from a playing card infeed area to the playing card collection area, and a pivoting arm is located in the playing card infeed area, wherein the pivoting arm moves automatically from an engaged position to a disengaged position when the card infeed area is empty, and moves from the disengaged position to the engaged position when a number of cards in the card infeed area falls to a predetermined number. In some embodiments of the invention, a sensor sends a signal to the processor indicating a number of playing cards remaining in at least one storage area of the playing card collection area and when that number of playing cards in the at least one storage area of the playing card collection area is a predetermined number, the pivoting arm moves to a second engaged position. Once engaged, the arm continues to pivot in response to being driven while cards are continually fed.

When the card handling device is a card shuffler, a set of grippers may be provided in the card collection area. The shuffler may further comprise a stationary card feeder and an elevator, wherein cards are elevated to an elevation of the grippers and the grippers grasp card edges of a group of cards, and when the elevator is lowered, at least one card is suspended and a gap is created below the suspended at least one card and a card support surface of the elevator or any cards on the elevator for insertion of a next card. Exemplary shufflers may be processor controlled, and may further be equipped with a random number generator to randomly determine a number of cards to be suspended by means of the grippers. The processor may be configured so that when the random number generator provides a number of suspended playing cards equal to or less than a predetermined number, the processor directs a pivoting arm to rotate so that an end of the arm distal from a pivot point moves into a position proximate to and above a top of the uppermost suspended playing card or cards.

The present invention may also be characterized as a card handling device that includes a card infeed area that supports a stack of playing cards that has a playing card support surface. The card handling device includes a card removing system that removes playing cards individually from the bottom of the stack and delivers cards into a playing card collection area. The playing card collection area is a portion of the device where playing cards are received one at a time after being removed individually from the bottom of the stack. A pivoting arm is provided that moves between a first position where a distal end of the pivoting arm is not in contact with any playing cards in the playing card collection area and a second position where the distal end of the pivoting arm is in contact with a top card in the playing card collection area. A motor drives the pivoting arm causing the arm to continue to rotate during card feeding. A processor provides signals to the motor to move the pivoting arm between the first position and the second position in response to information received from a playing card counting system. The present invention also includes a playing card counting system that identifies total numbers of playing cards in at least one area in the playing card collection system.

In some embodiments, the playing card system comprises a random number generator that provides a random number of cards to be separated from an entire set of cards as an uppermost subset of playing cards, and it is the random number of playing cards in the uppermost subset of playing cards that is compared to a predetermined number of playing cards to determine whether the pivoting arm should be moved into a position proximate a top surface of the suspended cards. In other embodiments, the pivoting arm is moved into a position proximate the suspended cards regardless of card count or other sensed information.

A playing card handling device is disclosed, comprising a card infeed area that supports a stack of playing cards that has a playing card support surface. A card removing system that removes playing cards individually from the bottom of the stack is provided. A playing card collection area is provided where playing cards are received one at a time after being removed individually from the bottom of the stack. A first pivoting arm is movable between a first position where a distal end of the pivoting arm is not in contact with any playing cards in the playing card collection area and a second position where the distal end of the pivoting arm is in contact with a top card in the playing card collection area. According to the invention, a motor is provided to pivot the first pivoting arm. Pivoting preferably continues during card feeding. A processor in the card handling device provides signals to the motor to move the first pivoting arm between the first position and the second position.

A playing card counting system that identifies total numbers of playing cards remaining in at least one area in the playing card collection system is provided. The playing card counting system comprises a random number generator that provides a random number of cards to be separated from an entire set of cards as an uppermost subset of playing cards, and it is the random number of playing cards in the uppermost subset of playing cards that is compared to a predetermined number of playing cards to determine whether a pivoting arm should be rotated to a position proximate a top separated card in the first position or in the second position.

The present invention includes a method of handling playing cards. The method comprises a step of positioning a vertically disposed stack of playing cards into a card storing area of a card handling device. A card moving system is provided that moves cards individually out of the card storing area and into a second area from the bottom of the stack. Included in the method is a step of measuring at least one parameter selected from the group consisting of: a number of cards fed from the card storing area, a number of cards remaining in the card storing area, a height of the stack of cards in the card storing area and a percent of cards fed. According to the method, when a predetermined value of a parameter is measured, a force is provided to an uppermost card in the stack in the card storing area, increasing a force between a lowest card in the stack and the card moving system. This added force remains on the cards during feeding, and assures accurate transfer of cards out of the card storing area of the card handling device.

In a preferred embodiment, the first area is a card infeed tray and the second area is a card shuffling area. Cards stored in the card shuffling area may be stored temporarily as part of a shuffling process. When cards are temporarily stored in the second area, methods of the present invention include the step of shuffling the cards. In some embodiments of the invention, shuffling can be accomplished by separating the stack in a randomly determined location, creating a gap in the stack at the randomly determined location, inserting a card, and then repeating the steps of randomly determining a location, creating a gap and inserting a card.

Methods of the present invention include methods of handling playing cards, comprising the step of positioning a plurality of stacked cards in a card handling area. According to the method, a location to divide the stack is selected. Preferably, this selection step is accomplished by means of a processor, and the use of a random number generator in communication with the processor. Random number generators may be in the form of software, hardware or the combination of software and hardware. According to one of the methods, a gap is created at the selected location by suspending all cards above the selected location in the stack. When a number of suspended cards is at or below a predetermined number, a pivotal arm is rotated to a position proximate a top surface of a top card in the suspended stack to prevent cards from moving out of suspension. In some embodiments, the gap created when the cards are suspended is accomplished by raising the stack of cards by means of an elevator to a stationary pair of opposing grippers. At least one of the grippers in a gripper pair moves horizontally to grasp the card edges. If too few cards are in the grippers, the cards bow and have a tendency to pop out of the grippers. By applying a blocking force above to a top card face, cards can be retained in the temporary storing location. Without the pivotal arm in place, if cards do pop out of the grippers, they may become vertically aligned and fall into a lower portion of the card shuffling area, where they remain until the cards are manually removed.

When the card handling device includes a shuffling mechanism, according to a method of the present invention, it is desirable to provide a step of providing a stack of cards in a card storing area, and moving cards individually into the card handling area of the shuffling mechanism. Cards placed in the card handling device may be fed individually from a bottom of a vertically positioned stack in the card storing area.

According to one of the methods, when a gap is created in the cards to allow the insertion of the next card, an elevator may be provided to raise the stack to a predetermined elevation so that stationary grippers can grasp an upper portion of the stack. Advantageously, an elevator may be provided to raise the stack. The predetermined location may be randomly selected by the processor, or the random number generator that is in data communication with the processor.

According to a preferred method of the present invention, a gap is created in the stack by elevating cards to a preselected elevation, grasping a number of cards above the selected location and then lowering the cards that were not grasped to create an opening for insertion of a next card. An elevator is preferably used for raising and lowering the cards. The pivotal arm may be rotated back to a retracted position either prior to, during or after grippers release the cards. Preferably, the pivotal arm is rotated back just prior to releasing cards from the grippers.

Structures of the present invention may be used in combination with a variety of card handling devices, such as mechanized card shoes, card set checking devices, automatic card shufflers, card sorting devices, card decommissioning devices, and the like. Although preferred structures are used in connection with substantially vertical card stacks with gravity feed systems, pivotal arms of the present invention may be used to apply forces to cards that are in horizontally aligned stacks, and stacks that are positioned at an angle with respect to the vertical. For example, it might be advantageous to provide a card stack that is tipped 5 degrees to 10 degrees with respect to the vertical so that manual card stack insertion and alignment is made easier.

Structures of the present invention are useful to incorporate into a card input or infeed section of a card handling device, or in other areas of the device that hold cards, regardless of how much time the cards remain in a particular area of the card handling device. For example, pivotal arms of the present invention may be used to assist in accurately retaining cards in a temporary storing area, where cards are stored as part of a shuffling process. Other storage areas hold cards in a card input area, in a completed processed set area, and in other temporary storage locations, regardless of the duration of the storage time. It can be readily appreciated that stacks of cards may be formed in various locations within the card handling device and the present technology may also be used to move cards from internally formed stacks within the device to another area of the device, such as an output tray, for example.

Although structures and methods of the present invention may be applied to vertically disposed stacks of cards that retain card surfaces in a horizontal plane in adjacent card face to card back relationship, the invention may be used to facilitate card movement from stacks that are horizontally oriented, or are oriented at an angle with respect to the horizontal or vertical. For example, structures and methods of the present invention may be also used in connection with delivering cards on a declining surface in a shoe.

Suitable shuffling mechanisms that may be used in connection with the present invention encompass many different types of shuffling technologies, such as random card ejection technology (i.e., U.S. Pat. No. 7,066,464 to Blad et al.), random distribution of cards into compartments within a stack of cards (i.e., U.S. Pat. No. 6,254,096 to Grauzer), distribution of cards into a circular carousel of compartments (i.e., U.S. Pat. No. 6,659,460 to Blaha et al.), distribution of cards into a fan array of compartments, distribution of cards into an opening that was randomly selected and then created in a stack (i.e., U.S. Pat. No. 6,651,981 to Grauzer et al.), etc. The disclosure of each of these patents is hereby incorporated herein by reference in its entirety.

In a first embodiment of the present technology, as shown in FIG. 1, a set of playing cards 6 is placed as a vertically disposed stack into a card infeed area 5 of a card handling device. Although the cards 6 are vertically stacked (with the face of each card being in a horizontal plane) within the card infeed area 5 in this embodiment, the stack of cards 6 may also be slightly angled (e.g., +/−30 degrees from horizontal). The cards 6 are stacked in the card infeed area 5 and then the cards 6 are removed one at a time from the bottom of the set of cards 6 by means of pick-off rollers 22, 23. Cards 6 are individually moved to speed-up roller pair 28, 30 where they are delivered into a shuffling mechanism (not shown). An exemplary shuffling mechanism for randomizing the stack of cards 6 is described in U.S. Pat. No. 6,651,981 to Grauzer et al. Preferably, the cards 6 are placed in the card infeed area 5 face down, so that no card value is exposed to the players or dealer, but this is not of functional importance to the practice of the present technology.

Systems that move cards out of a substantially vertically disposed stack of cards from the bottom of the stack are referred to in the casino supply industry as "gravity feed" systems. In gravity feed systems, playing cards are removed from the bottom of the stack, and the weight of the stack applies a downward force to the card moving structure. Typically, a friction wheel 22 (referred to as a pick-off roller) extends upwardly and into the bottom of the playing card input chamber, and into contact with a lowermost card in the stack. Rotation of the pick-off roller 22 provides a driving force against the playing card, forcing the playing card horizontally out of the card input chamber and toward the shuffling area.

Figure 2:
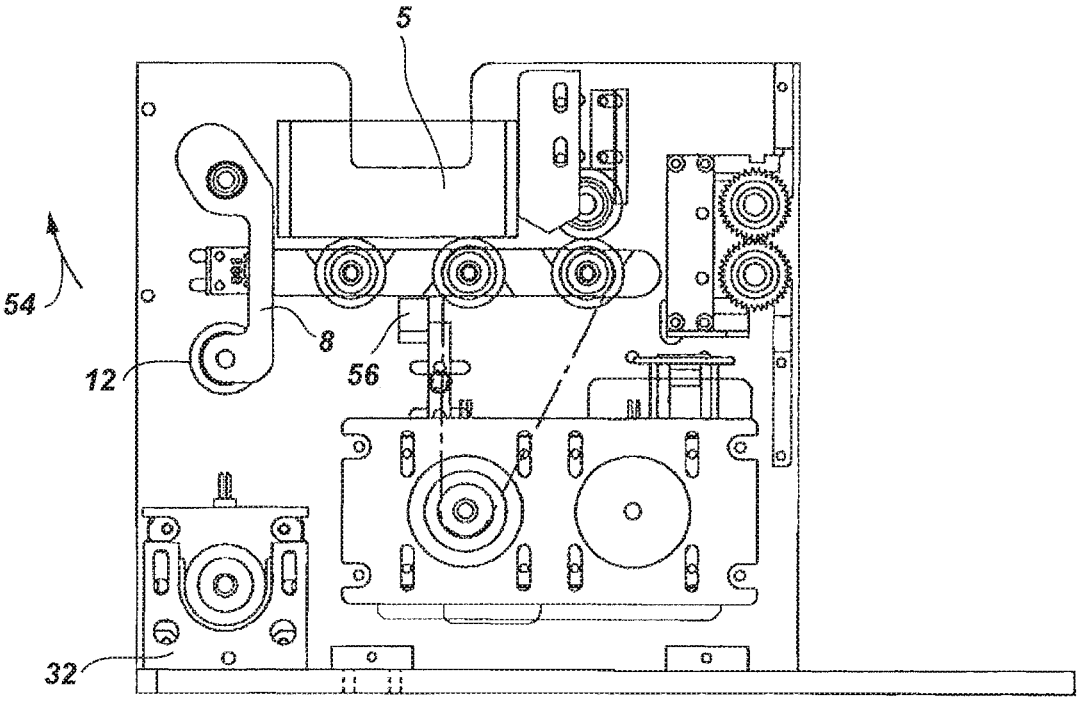
FIG. 2 shows a second side elevational view of the first exemplary card handling system.

A pivoting arm 8 is fixedly mounted to a frame 60 at pivot point 10. In a card engaging position, as shown in FIG. 1, roller 12 contacts an upper surface of the top card in the stack of cards 6, applying a downward force on the stack of cards 6. The pivoting arm 8 is rotated by means of a stepper motor 32 that drives pulley 36, which in turn drives pulley 38 by means of belt 64. As shown in FIG. 2, the pivoting arm 8 in a retracted position is clear of the card infeed area 5 when in a card disengaging position. The pivoting arm 8 does not interfere with card loading, because the entire pivoting arm 8 is removed from the card infeed area 5.

Embodiments of the card handling device of the present disclosure incorporate at least one sensor to indicate the position or a degree of rotation of the pivoting arm, or incorporate other sensors to indicate a number of cards remaining in the card storing area. The position of the movable weight in some instances can be used as an indication of whether or not cards are present in the card storage area. In other embodiments, a card present sensor is also provided in the card storing area to indicate an absence or presence of one or more cards.

Embodiments of the present invention are used in connection with card handling devices that maintain a count of playing cards in the playing card infeed area during card handling operation of the device. Card handling devices are preferably processor controlled. The processor may be in communication with at least one sensor, such as a pivoting arm position sensor, a card present sensor, a card counter or other sensor. The processor is capable of determining that a predetermined maximum number of playing cards has been reached after removal of a portion of the set of playing cards from the playing card infeed area. In response to meeting this condition, the processor causes activation of a drive mechanism to pivot the pivoting arm into a card engaging position. Pivoting arms of the present invention advantageously apply more force to a top card in the stack than known card weight systems. In addition to the weight of the arm, additional forces are applied by the drive system during card moving.

Within the card handling device, there may be a shuffling system that moves cards individually from the playing card infeed area into a card shuffling mechanism. During shuffling, cards may be temporarily stored in a temporary card storing area. A random number generator determines a location in the stack to suspend cards. In most instances, the stack is divided into two sub-stacks. In other instances, all of the cards, or none of the cards are suspended. This determination, in turn, determines how many cards are temporarily stored in the area of suspension. When a threshold number of cards or fewer is present in the temporary storing area, a pivotal arm is activated to move the arm over the top of the suspended cards, close enough to the cards to prevent the cards from flipping over if a card pops out of the grippers. In one embodiment, this proximate relationship is a few card thicknesses. In other examples, the distance is between one card thickness and a dimension of a card length or width. During operation, the pivotal arm provides a barrier to stop cards from flipping over. Unless cards pop out of the grippers, no contact is made between the arm and the cards. For example, a vertical stack of cards may be temporarily stored in a pair of spaced-apart horizontally reciprocating grippers and a pivotal arm may be provided above the gripped stack to stop cards that have popped out of the grippers from flipping over and falling vertically down the side of the stack. A suitable gripper set grasps cards by moving horizontally while the structure is fixed in the vertical direction. Shortly before, during or after the gripper is released, the processor directs the pivotal arm to disengage the cards. In other embodiments, the pivotal arm remains in the engaged position when the grippers release the cards.

The pivotal arm of the present invention may be positioned over cards in the grippers at all times, or when relatively few cards are gripped. When there are a small number of cards in the grippers, the force of the grippers is more likely to cause cards to bow and pop out and flip. It may be desirable to cause the flipper to move into a "bracing" position when a threshold number of cards or fewer are gripped.

For example, a threshold number of gripped cards may be ten cards. The number of cards defining the threshold amount can vary, depending on the type of cards, card weight, and frictional characteristics of the card. For example, plastic cards are typically thicker and more rigid than paper cards. In that instance, the threshold number of cards could be lower than when the device is programmed to process paper cards of a certain manufacturer. In general, suitable threshold amounts for a variety of playing cards used in U.S. casinos would be between eight and fourteen cards, and preferably about ten cards.

When the random number generator selects a location in the stack to separate the cards, the processor determines how many cards are retained in the grippers. Alternatively, the processor selects a card in the stack and determines whether that card and the cards above that card should be gripped. Or, the selected card is determined to be part of the lower sub-stack. If the number of gripped cards is less than or equal to ten cards, for example, the pivotal arm is activated to move into a bracing position.

Referring back to FIGS. 1 and 2, the use of a pivoting arm 8 with a center of rotation of the pivoting arm 8 that is below a point that is spaced above, and preferably at least 15 mm above, the card support surface in the card infeed area 5 is illustrated. The center of rotation may alternatively be located above the playing card support surface by at least 18 mm, at least 20 mm or at least 25 mm or more. Preferably, the pivot point 10 is also spaced apart from the card infeed area 5. The ability to provide this elevation of the pivot point 10 of the pivoting arm 8 in relation to the playing card surface allows for a lower height to the system, better consistency of weight against the cards, and the like. The relative elevation is provided by having a pivoting arm 8 that extends above the pivot point 10 on one end of the pivoting arm 8 and also above a playing card contact point 9 on the other end of the pivoting arm 8. This creates an elevated middle area or recess in the pivoting arm 8, which can extend over the edge of the playing cards 6 in the card infeed area 5 to avoid contact with those cards. In other words, the pivoting arm 8 of the pivotal weight is advantageously U-shaped.

A second concept developed herein is the use of a motor-driven pivoting arm 8 that controls the height of the contact point 9 and/or the force at the contact point 9 and/or the retraction/lowering of the pivoting arm 8 and/or other actions by the pivoting arm 8 with respect to the loading, unloading and shuffling process, including addressing any card jam events. FIG. 1 shows a sectioned or cutaway side elevational view of a playing card feeding portion 2 of a playing card handling system. The height of a set of cards 6 (e.g., a single deck of cards is illustrated) is shown in the playing card receiving or card infeed area 5. A pivoting arm 8 is shown with a roller 12 pivotally mounted about rotational shaft 14 at the contact end of the pivoting arm 8 resting on the top of the set of cards 6. This may represent a locked or controlled position of the pivoting arm 8. The pivoting arm 8 pivots about pivot point 10 and the roller 12 pivots about rotational shaft 14. A dashed line 16 is shown between the pivot point 10 and the lower surface of the roller 12. As can be seen, this dashed line 16 intersects the height of the playing cards 6, which would mean that the traditional straight weighted arm (as taught by Frisco, above) would rest against the edge of the cards and possibly interfere with, damage or mark the cards. As is shown in FIG. 1, there is a significant gap 18 above the dashed line 16 and the height of the set of playing cards 6 in the card infeed area 5. This structure prevents the need for elevating the pivot point 10 of the pivoting arm 8 above the height of the uppermost card in the stack of cards 6. When the pivoting arm 8 and pivot point 10 have to be so elevated, the overall height of the shuffler is increased. Additionally, other functioning parts of the arm system, (i.e., the belts if used, drive wheels and the shaft, for example) may be exposed and subject to damage from the exposure.

A bottommost playing card 7 is driven by pick-off rollers 22, 23 through an outlet slot 24 in the bottom of the playing card infeed area 5. The playing card 7 driven though the slot 24 then engages speed-up rollers 28 and 30, which form a nip 26 that moves the playing card 7 into the shuffling area of the shuffler (not shown). A motor 40 drives shaft 42. Shaft 42 rotates, causing sheaves 44, 46 and 48 to rotate. An endless member 50 contacts sheaves 44, 46 and 48.

A stepper motor 32 is provided to drive a drive wheel 34 with drive belt 64 that also engages pulley 38, causing the weighted pivoting arm 8 to pivot. Once the last card exits the card infeed area 5, the pivoting arm 8 rotates downwardly in a direction of arrow 52 into a retracted position. In the retracted position, as shown in FIG. 2, the pivoting arm 8 is completely free of the card infeed area 5. Cards can be manually loaded without any interference from the pivoting arm 8.

After the next group of cards is inserted into the card infeed area 5, the pivoting arm 8 continues to rotate in a clockwise direction, as shown by arrow 54 (FIG. 2), until the roller 12 comes back into contact with the top card in the next stack. Alternatively, the pivoting arm 8 rotates in an opposite direction to a position that is free of the card infeed area (not shown). The card weight advantageously retracts and does not interfere with the loading of cards. A card present sensor 56 may send a signal to the processor (not shown) that in turn actuates stepper motor 32 to rotate pivoting arm 8 into the "card engaged" position.

Operation of the pivoting arm 8 may be controlled by a processor (not shown) and/or react to sensors or be free in its pivoting. When the pivoting arm 8 has the gap 18 built in, the pivoting arm 8 may pivot and retain cards under its own weight. Because of the initial elevation of the pivoting arm 8 (as shown by the angle of dashed line 16 with respect to the horizontal), the pivoting arm 8 will initially (under its own weight) pivot first toward the horizontal and then slightly below the horizontal. The contact point 9 between the roller 12 and the top surface of the uppermost playing card will also move from a non-centered position toward a more centered position, as the height of the stack of playing cards 6 changes. This orientation of the pivoting arm 8 with a roller 12 thereon reduces damage to surfaces of the cards that are contacted by the roller 12.

When the pivoting arm 8 is motor driven, an intelligent drive system (as with a processor, microprocessor or computer, with "processor" used generically) may assist in driving the positioning of the pivoting arm 8 and apply contact pressure between the pivoting arm 8 and the top of the set of playing cards 6 in the card infeed area 5. The application of pressure can be accomplished a number of ways. For example, the processor may instruct the stepper motor 32 to move a defined number of steps or positions for each fed card.

One mode of operation of the intelligent drive system may include some or all of the following features. When no playing cards are present in the chamber (signals or data of which may be obtained from card present sensors or cameras), the processor may direct the pivoting arm 8 to be rotated into a retracted position to facilitate depositing of the playing cards by hand. When the processor is provided with information such as signals or data indicating that playing cards 6 are positioned in the card infeed area 5, the pivoting arm 8 is rotated (clockwise in FIG. 1) until contact is sufficiently made with the top of playing cards 6. This sensing may be accomplished in numerous ways, as with a contact sensor (not shown) in the rotational shaft 14, tension reduction sensed in the pulley 36 through the stepper motor 32, cameras or optical sensors (not shown) in the card infeed area 5, and the like. Once contact is made, the pivoting arm 8 may remain under tension by the drive system or become free in its rotating by disengaging gearing or pulleys (e.g., pulley 36) driving the pivoting arm 8. Alternatively, upon removal of cards, the processor will adjust the tension in the pulley 36 to adjust the contact force of the roller 12 against playing cards 6. This adjustment may be done continually, periodically or at specific event occurrences, such as the movement of a single card, the movement of a specific number of cards out of the card infeed area 5, or the like. The force applied by the roller 12 to the top playing cards should usually be sufficient that removal of a single card from the bottom of the set of cards 6 will not completely remove the force applied by the roller 12.

The system may also indicate the absence of playing cards in the card infeed area 5. For example, a card present sensor 56 may indicate that no cards are in the card infeed area 5. The system may utilize the same sensors that indicate the presence of cards in the playing card infeed area 5 to indicate the absence of cards in the card infeed area 5. Alternatively, the arm itself may be associated with various sensors to indicate the absence of playing cards in the card input chamber. For example, when there are no cards in the chamber, the arm may continue to rotate clockwise to a "retracted" position. The arm (as associated sensors or systems that measure the degree of rotation of the arm) may be preprogrammed or trained to recognize the lowest position of the arm with a single card in the chamber. When that position or degree of rotation is subsequently exceeded, a signal will be sent to send the pivoting arm 8 to the lowest position (shown in FIG. 2).

As noted above, the end of the arm is provided with a roller, but a low-friction surface may also be provided in place of the roller. For example, a smooth, flat, rounded edge with a polymeric coating (e.g., fluorinated polymer, polysiloxane polymer, polyurethane, etc.) can provide a low-friction surface that will slide over the playing cards without scratching the cards.

Some of the properties of the exemplary pivotally mounted card weight arm with the roller or glide surface thereon are: essentially downward (toward the cards) a free-swinging or controlled arm, with a lower edge gap that extends over edges of playing cards when the arm is elevated; a sensing device identifying the position of the arm along its path of movement, the sensed position including sensing of a position of the arm or contact of the arm, indicating the presence, absence or approximate amount (number) of cards in the card infeed area, the sensor signaling a processor that commands a motor attached to a belt that can motivate the weighted arm into a contact position and a retracted position; and an automatic sequence that rotates the weighted arm into a retracted position to allow insertion of additional cards into the shuffler.

Although the pivoting arm may move freely about the pivot point, in one form of the invention, the pivoting arm is spring-loaded such that a force must be applied to the arm in order to raise the arm high enough to insert cards. In another form of the invention, the card feeding device includes a computer-controlled drive system. An exemplary drive system includes a motor that rotates the pivoting arm about the pivot point (or pivotal shaft). In a first engaged position, a contact end of the pivoting arm applies a downward force to the stack of cards. The drive, the weight of the arm, or both apply a downward force to the cards. When the pivoting arm is rotated by a motorized drive system, the motor positions the pivoting arm to apply pressure against the card at the top of the stack.

Sensors may be provided to signal the microprocessor to instruct the drive system to rotate the pivoting arm. An example of one sensor is a position sensor located on the pivotal shaft. This sensor provides an indication of the position or degree of rotation of the pivoting arm. Each provided sensor is in communication with the processor. The processor may also instruct the motor to alter the position of the pivoting arm upon receiving a sensor signal. Another example of a suitable sensor is a card present sensor located on or beneath the card support surface.

One preferred drive motor is a stepper motor. The stepper motor may rotate in two directions or just in a single direction. When the motor rotates the pivoting arm in a single direction, the pivoting arm is capable of moving from a recessed position back into a card engaging position without interfering with card loading. Preferably, the pivoting arm is completely concealed within an interior of the machine when in the recessed position. When in the recessed position, no part of the pivoting arm extends into the card infeed area, leaving the area free for typical card loading.

Figure 3:
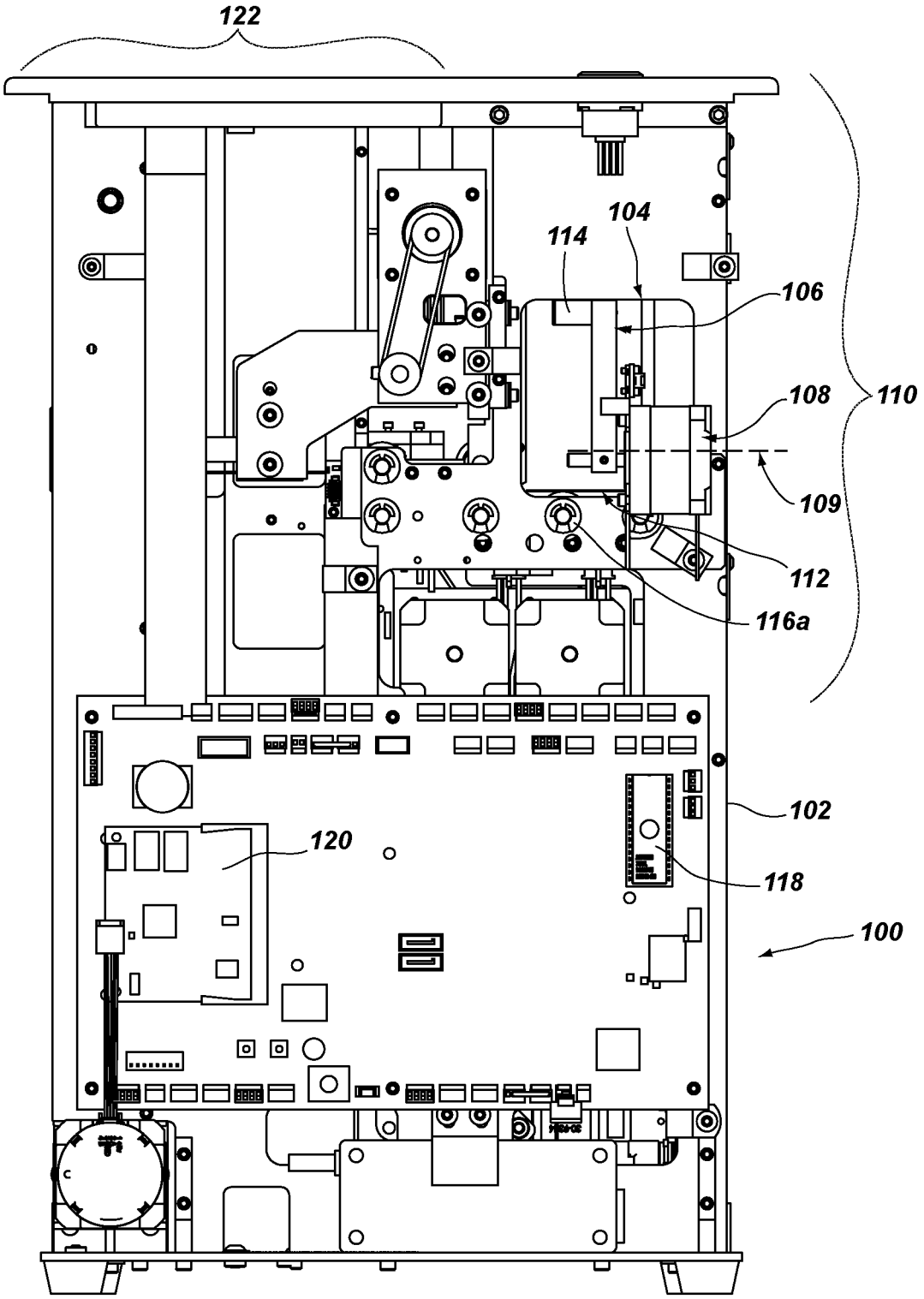
FIG. 3 shows a front elevational view of a second exemplary card handling device of the present invention.

Reference to FIGS. 3 through 6 shows an alternative embodiment that employs the technology of the present invention. FIG. 3 shows a frontal elevational view of shuffler 100 with the housing removed. The shuffler 100 has a support structure 102 adjacent to a card infeed area 110 of the shuffler 100. Cards (not shown) are placed within card receiving chamber 104 through an access opening (not shown) in an upper surface of the shuffler 100 and the card stack is seated at its lowest level 112 within the card receiving chamber 104. The lowest level 112 represents a card support surface. As cards are removed one at a time from the card receiving chamber 104, and moved to a shuffling area 122, the number of cards removed is counted. The number of original cards input into the shuffler 100 is known (by preprogramming or user input at the time of the input), and by deducting the number of cards removed from the card receiving chamber 104, the number of cards remaining in the card receiving chamber 104 are known. A processor 120 is preprogrammed to direct activation and position of a card weight motor 108, which card weight motor 108 causes a card weight arm 106 to rotate (into the direction of the paper) about axis 109 from its raised position (shown) to a card engaging position (not shown) where it presses against the flat top of cards in the card receiving chamber 104. The mass of the arm 106 and, preferably, also light spring pressure from an arm extension or extended spring element 114, applies force from the top of the predetermined number of cards in the card receiving chamber 104 through the cards, to a lowermost card in the card receiving chamber 104 so that the lowermost card is pressed against a first pick-off roller 116*a*. A random number generator module 118, described in more detail below, is in communication with the processor 120 and is also shown in FIG. 3.

Figure 4:
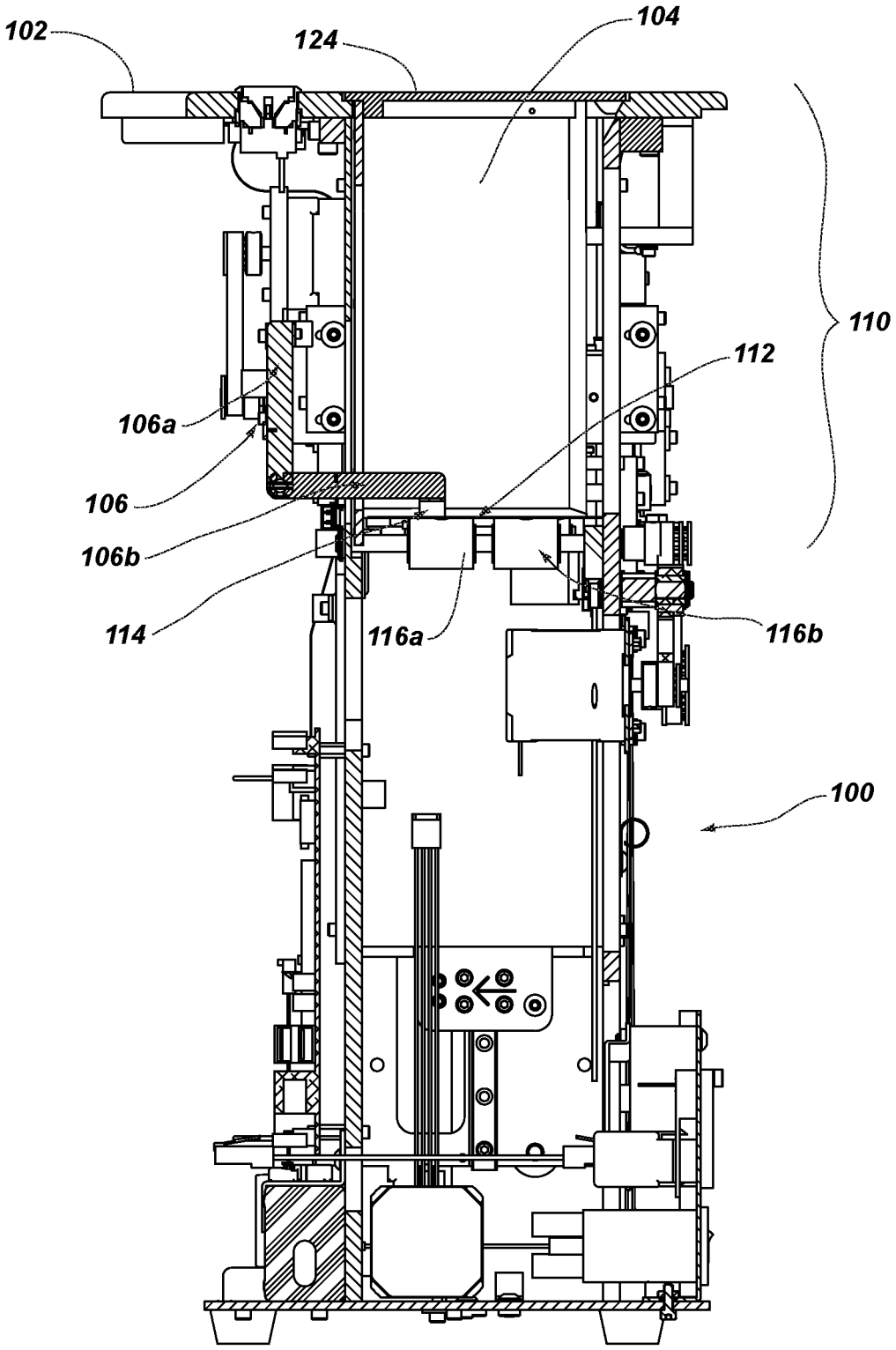
FIG. 4 shows a first side elevational view of the second exemplary card handling device of the present invention.

FIG. 4 shows a side elevational view of the shuffler 100 with the housing removed. Above the card receiving chamber 104 where playing cards are fed into the shuffler 100 is a pivoting lid 124. An elevated pivoting card weight arm 106 is shown in a retracted or "disengaged" position 106*a*, outside of the card receiving chamber 104. Also shown in FIG. 4 is the same card weight arm 106, or pivotal arm, in a lowered or "engaged" position 106*b*. Of course these two positions 106*a*, 106*b* cannot be present at the same time, as there is a single arm (106 of FIG. 3), but these views show the movement of the arm 106 between positions 106*a* and 106*b*. The spring element 114 is shown in contact with the first pick-off roller 116*a* and not in contact with the axially aligned second pick-off roller 116*b*. One suitable spring is formed of plastic. Other materials, such as metallic materials, may be used to form a spring. The lowest level 112 of the card receiving chamber 104 can be seen with no playing cards in the card receiving chamber 104. This is why the spring element 114 is in contact with the pick-off roller 116*a*. All reference numerals in FIG. 4 that are the same as reference numerals in FIG. 3 show similar components of the shuffler 100. When a predetermined number of cards (or fewer) are left in card receiving chamber 104 during card feeding, card weight arm 106 moves from the card disengaged position 106*a* to the card engaged position 106*b*.

Figure 5:
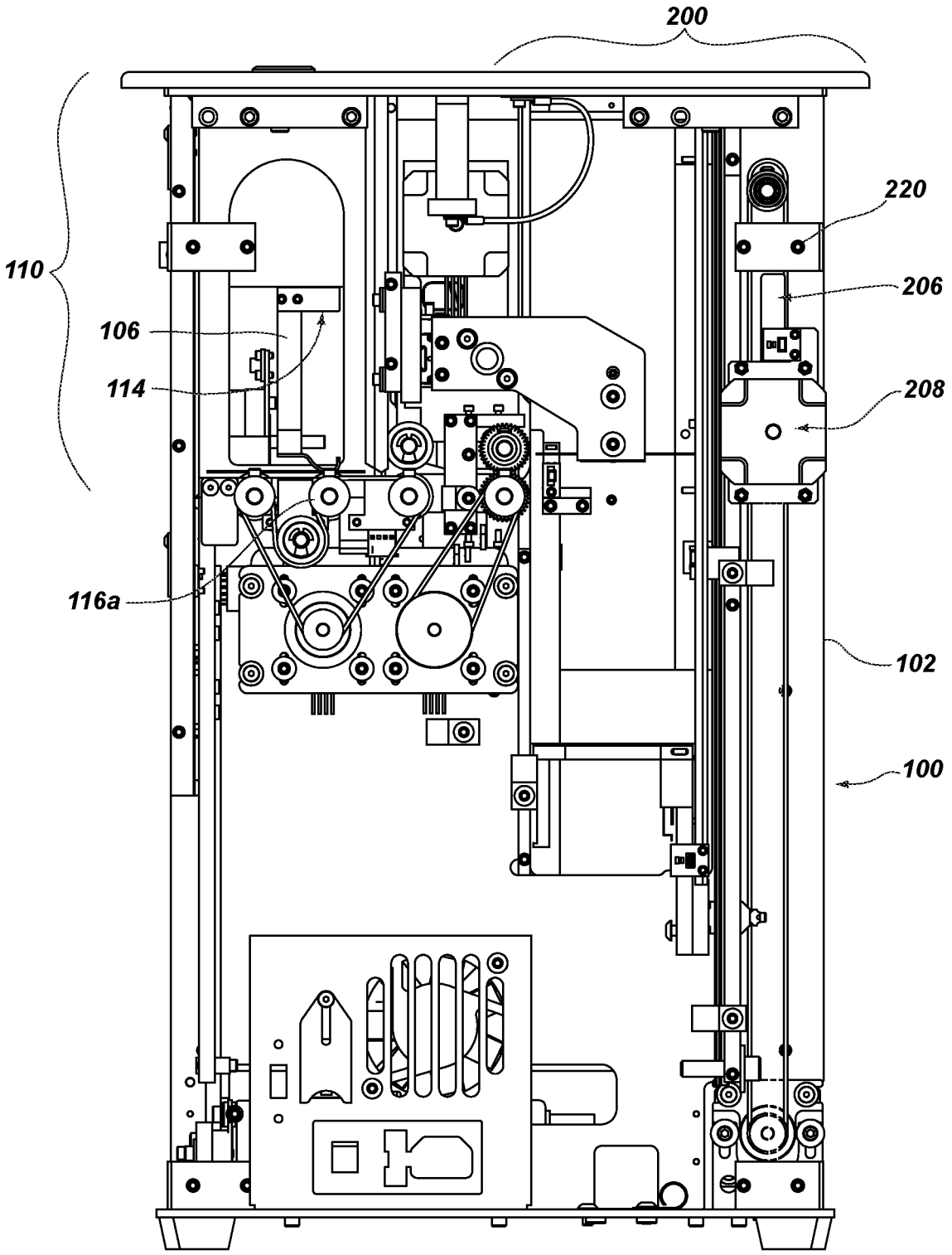
FIG. 5 shows a rear elevational view of the second exemplary card handling device of the present invention.

FIG. 5 shows a rear elevational view of the shuffler 100 with the housing removed. This view is opposite the view shown in FIG. 3. Card infeed area 110 is on the opposite side in FIG. 5. A card anti-flip arm 206 (also referred to above as a pivoting arm) is shown within the card shuffling or card collection area 200. A motor 208 for the card anti-flip arm 206 is shown, the card anti-flip arm 206 being shown in an upright (inactive) position. All reference numerals in FIG. 5 that are the same as reference numerals in FIG. 3 or FIG. 4 show similar components of the shuffler 100. In a preferred embodiment, when cards are present in grippers 220, the card anti-flip arm 206 is moved to an active position (i.e., horizontal) to prevent cards from flipping over.

In another embodiment, when the random number generator module (e.g., 118 of FIG. 3) identifies to the processor (120 in FIG. 3) that fewer than or equal to a predetermined number of playing cards are to be supported during shuffling, the playing card anti-flip arm 206 will move from an inactive to an active position. The card anti-flip arm 206 will retract to the inactive position at a predetermined time, which may be as a card is inserted below the supported card(s), after the card has been inserted below the supported card(s) or after the supported cards are combined with the cards on an elevator or before another number of playing cards is supported.

Figure 6:
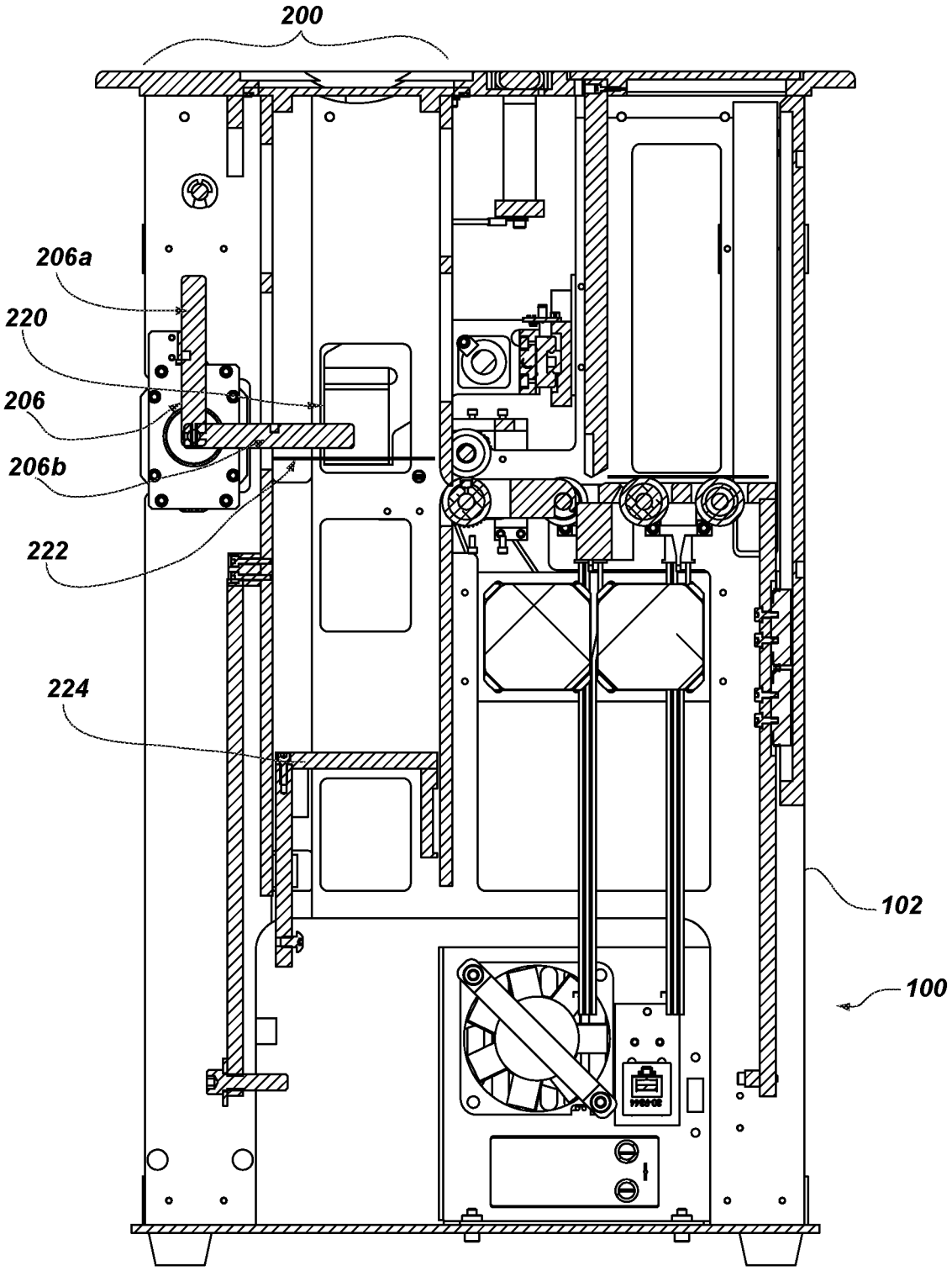
FIG. 6 shows another front elevational view of the second exemplary card handling device of the present invention with a pivotal weight arm rotated into a card-contacting position.

FIG. 6 shows a side cross-sectional view of the shuffler 100 with the housing removed, in a plane that clearly shows the operation of the card anti-flip arm 206. In the retracted or inactive position 206*a*, card anti-flip arm 206 is outside of the temporary card collection area 200, and when rotated to an engaged position 206*b*, the card anti-flip arm 206 is substantially horizontal. A small number of playing cards 222 is shown supported by one of a pair of spaced-apart grippers 220. When that number of playing cards 222 is less than or equal to a predetermined number of playing cards (e.g., 3, 4, 5, 6, 7, 8, 9, 10, etc.), the card anti-flip arm 206 is moved to position 206*b* to prevent any cards that pop out of the grippers 220 from flipping, which could cause jamming of the shuffler 100, or expose a card within the shuffled set by flipping the wrong side (face side) up in the shuffled set of cards, or causing gripped cards to become vertically aligned.

In some embodiments of the invention, when there are relatively few cards in the shuffling area 200, the playing card anti-flip arm 206 will remain in the engaged position 206*b* for some number of cards being inserted. An elevator 224 (FIG. 6) that supports and lowers playing cards (not shown) that are not gripped by the grippers 220 is also shown. After the initial number of cards are present in the shuffling area 200 and the random number generator has not selected a number of cards to be gripped less than or equal to the second predetermined number, the playing card anti-flip arm 206 will return to position 206*a*. When the random number generator selects a number of cards to be gripped less than or equal to the second predetermined number, the playing card anti-flip arm 206 will return to position 206*b* to be positioned above the playing cards 222 supported by the grippers 220.

Although specific examples, sequences and steps have been clearly described, variations and alternatives would be apparent to those skilled in the art and are intended to be within the scope of the invention claimed.

What is claimed is:

1. A playing card handling device, comprising:

a card storing area configured to support a stack of playing cards;

a card moving system configured to move cards individually from a bottom of the stack of playing cards in the card storing area;

a retractable arm mounted to a support structure of the playing card handling device, the retractable arm configured to selectively apply a force to the stack of playing cards in the card storing area against the card moving system in a contact position; and a processor configured to direct movement of the retractable arm from a retracted position to the contact position responsive to at least one predetermined parameter being met, wherein the retractable arm is located entirely outside the card storing area when the retractable arm is in the retracted position.

2. The playing card handling device of claim 1, wherein the retractable arm comprises a card weight that is pivotally mounted to a structure of the playing card handling device.

3. The playing card handling device of claim 1, wherein the retractable arm comprises a pivot point at a first end, a contact end at a second, opposite end, and a U-shaped arm between the first end and the second, opposite end such that the U-shaped arm is configured to avoid contact with the stack of playing cards.

4. The playing card handling device of claim 3, wherein the pivot point of the retractable arm is located exterior to the card storing area, the pivot point lying in a plane between a horizontal plane of a playing card support surface of the card storing area and a horizontal plane of a maximum height of the stack of playing cards.

5. The playing card handling device of claim 3, wherein the contact end of the retractable arm comprises at least one of a low-friction surface or a roller pivotally mounted about a rotational shaft proximate the second, opposite end of the retractable arm.

6. The playing card handling device of claim 3, wherein:

the contact end of the retractable arm is positioned below the pivot point when the retractable arm is in the retracted position; and the contact end is positioned directly above and in direct physical contact with an uppermost card of the stack of playing cards when the retractable arm is in the contact position.

7. The playing card handling device of claim 1, further comprising at least one sensor in communication with the processor, wherein the at least one sensor is configured to detect the at least one predetermined parameter.

8. The playing card handling device of claim 1, wherein the at least one predetermined parameter is selected from the group consisting of a number of cards fed from the card storing area, a number of cards remaining in the card storing area, a height of the stack of playing cards in the card storing area, a percentage of card feeding completion, a percentage of shuffle completion, and a weight of the stack of playing cards in the card storing area.

9. The playing card handling device of claim 1, further comprising a card shuffling area, wherein the card moving system is configured to move cards individually from the card storing area to the card shuffling area.

10. A method of operating a card handling device, the method comprising:

supporting a stack of playing cards with a support surface of a card storing area;

individually moving cards from a bottom of the stack of playing cards in the card storing area with a card moving system of the card handling device;

selectively applying a force to the stack of playing cards in the card storing area with a retractable arm in a contact position, the retractable arm being mounted to a support structure of the card handling device; and directing movement of the retractable arm from a retracted position entirely outside the card storing area to the contact position with a drive mechanism directed by a processor responsive to at least one predetermined parameter being met.

11. The method of claim 10, further comprising maintaining a count of a number of the cards in the card storing area with the processor during operation of the card handling device comprising counting a number of the cards as the cards are moved from the card storing area to a card shuffling area.

12. The method of claim 10, further comprising detecting the at least one predetermined parameter with at least one sensor comprising at least one of determining a number of the cards, detecting a weight of the cards, or detecting a position of the retractable arm with the at least one sensor.

13. The method of claim 10, wherein selectively applying the force to the stack of playing cards comprises applying pressure through the stack of playing cards to a lowermost card thereof with a spring located on an underside of the retractable arm such that the lowermost card is pressed against a pick-off roller of the card moving system.

14. The method of claim 10, wherein selectively applying the force to the stack of playing cards comprises directing the drive mechanism with the processor to apply an increased force as the stack of playing cards is reduced.

15. The method of claim 10, wherein directing movement of the retractable arm comprises:

receiving a signal with the processor;

directing the retractable arm to move from the retracted position to the contact position based at least in part on the signal; and directing a contact end of the retractable arm to provide weight to the stack of playing cards to push the stack of playing cards toward the card moving system.

16. A method of moving cards within a card handling device, the method comprising:

receiving a stack of playing cards within a card receiving area;

moving individual cards from a bottom of the stack of playing cards, using at least one roller of a card moving system of the card handling device;

receiving a signal with a processor that a remaining portion of the stack of playing cards within the card receiving area meets a predetermined value of a parameter;

applying a downward force to a top of the remaining portion of the stack of playing cards with a retractable arm in a contact position responsive to the signal, the retractable arm being mounted to a support structure of the card handling device;

maintaining the downward force with the retractable arm in the contact position until the remaining portion of the stack of playing cards has been removed from the card receiving area; and moving the retractable arm from the contact position to a retracted position entirely outside the card storing area with a motor-driven belt responsive to another signal indicating an absence of cards in the card receiving area.

17. The method of claim 16, wherein moving the retractable arm between the contact position and the retracted position comprises pivoting the retractable arm about a pivot point located external to the card receiving area.

18. The method of claim 17, wherein applying the downward force to the top of the remaining portion of the stack of playing cards comprises directing movement of the retractable arm from the retracted position to the contact position with the motor-driven belt.

19. The method of claim 16, wherein receiving the signal with the processor comprises sensing the predetermined value of the parameter with at least one sensor in communication with the processor.

20. The method of claim 19, wherein sensing the predetermined value of the parameter with the at least one sensor comprises detecting at least one of a number of cards remaining in the card receiving area, a height of the remaining portion of the stack of playing cards, or a weight of the remaining portion of the stack of playing cards.

* * * * *